US012270622B1

(12) United States Patent
Maughan et al.

(10) Patent No.: US 12,270,622 B1
(45) Date of Patent: Apr. 8, 2025

(54) FIREARM MAGAZINE WITH SHOULDER RETENTION

(71) Applicant: Browning, Morgan, UT (US)

(72) Inventors: Robert G. Maughan, Kaysville, UT (US); Ryan D. Cook, Morgan, UT (US)

(73) Assignee: BROWNING, Morgan, UT (US)

( * ) Notice: Subject to any disclaimer, the term of this patent is extended or adjusted under 35 U.S.C. 154(b) by 0 days.

(21) Appl. No.: 18/415,020

(22) Filed: Jan. 17, 2024

(51) Int. Cl.

| | |
|---|---|
| ***F41A 9/71*** | (2006.01) |
| ***F41A 9/70*** | (2006.01) |
| *F41A 9/69* | (2006.01) |
| *F41A 9/73* | (2006.01) |

(52) U.S. Cl.
CPC ..... *F41A 9/71* (2013.01); *F41A 9/70* (2013.01); *F41A 9/69* (2013.01); *F41A 9/73* (2013.01)

(58) Field of Classification Search
CPC ..... F41A 9/71; F41A 9/70
USPC ..... 42/49.01, 49.02, 50
See application file for complete search history.

(56) References Cited

U.S. PATENT DOCUMENTS

| | | | |
|---|---|---|---|
| 1,898,670 | A | 2/1933 | Laudensack |
| 2,296,729 | A | 9/1942 | Mossberg |
| 2,895,248 | A | 7/1959 | Sawin |
| 3,395,479 | A | 8/1968 | Collins |
| 4,139,958 | A | 2/1979 | Foote |
| 4,329,802 | A | 5/1982 | Coonan |
| 7,698,844 | B2 | 4/2010 | Gruber et al. |
| 8,028,455 | B1 | 10/2011 | Battaglia |
| 8,156,675 | B2 | 4/2012 | Heath |
| 8,322,063 | B1 | 12/2012 | Battaglia |
| 8,484,875 | B2 | 7/2013 | Heath |
| 8,745,912 | B2 | 6/2014 | Heath |
| 10,228,202 | B2 | 3/2019 | Jarboe |
| 10,495,399 | B1 | 12/2019 | Dalessio et al. |
| 10,598,454 | B2 | 3/2020 | Dichario et al. |
| 10,921,075 | B2 | 2/2021 | Brown et al. |
| 11,493,293 | B2 | 11/2022 | Brown et al. |
| 2009/0223103 | A1 | 9/2009 | Young |
| 2014/0250752 | A1 | 9/2014 | Heath |

*Primary Examiner* — Reginald S Tillman, Jr.
(74) *Attorney, Agent, or Firm* — DORSEY & WHITNEY LLP

(57) ABSTRACT

An adjustable insert for a firearm magazine can include: a contact surface to contact a cartridge shoulder; and an engagement interface positioned on a mating surface, the engagement interface being engageable with a portion of the firearm magazine, wherein the mating surface is positioned perpendicular to the contact surface; and wherein the engagement interface includes a predetermined adjustment resolution for incrementally adjusting the adjustable insert forward and backward along a plane parallel to a longitudinal axis of the firearm magazine to accommodate multiple sizes of cartridges.

20 Claims, 16 Drawing Sheets

FIREARM MAGAZINE WITH SHOULDER RETENTION

FIELD

This disclosure relates generally to firearms (e.g., rifles). More particularly, this disclosure relates to magazines for use with firearms.

BACKGROUND

A magazine is an ammunition storage and feeding device used with a firearm. The magazine holds ammunition cartridges and can facilitate feeding of the cartridges into the chamber of the firearm (e.g., handgun, rifle, or shotgun). Most magazines are configured to be easily inserted into and removed from the firearm. Some magazines are formed as an integral part of the firearm. Conventional magazines can also have any of a number of configurations such as, for example, tubular magazines, box magazines, drum magazines, rotary magazines, pan magazines, and helical magazines.

Unfortunately conventional magazines can suffer from various problems. One problem is that the design of many conventional magazines allows the cartridges to move forward inside the magazine until the bullet impacts the front of the magazine. Thus, each time the firearm is fired, the recoil causes the magazine to move backwards quickly with the firearm. Since the cartridges are not secured in place, the cartridges move (relative to the magazine) forward longitudinally in the magazine until the bullets impact the front of the magazine. This blunt trauma can deform and/or otherwise damage the bullets, which may alter the bullets' flight properties and consequently the bullets' accuracy.

Few conventional magazines have sought to address these issues with shoulder retention features. One reason that so few magazines include shoulder retention is that shoulder retention—according to conventional design-requires a specific magazine for each family of similar cartridge geometry. That is, conventional magazines with shoulder retention designs are custom made for cartridge families with similar geometries. Tooling and manufacturing is, therefore, more expensive and unwieldy.

The subject matter claimed herein is not limited to aspects that solve any disadvantages or that operate only in environments such as those described above. Rather, this background is only provided to illustrate one example technology area where some aspects described herein may be practiced.

SUMMARY

An aspect of the present disclosure relates to a firearm magazine. The firearm magazine can include: a housing including an upper periphery, a lower periphery, and an interior surface extending between the upper periphery and the lower periphery, wherein the interior surface defines a cavity sized to receive multiple sizes of cartridges; housing teeth positioned on at least one of the upper periphery, the lower periphery, or the interior surface; and an adjustable shoulder positioned within the housing, the adjustable shoulder including: shoulder teeth engageable with the housing teeth; and a stop surface engageable with a cartridge shoulder.

In some examples, a positioning of the adjustable shoulder relative to the housing teeth defines an axial shoulder spacing between the cartridge shoulder and the stop surface. In one example, the adjustable shoulder is translatable in a direction parallel to a cartridge. In at least one example, the adjustable shoulder is removable from the firearm magazine. In certain examples, the adjustable shoulder includes a pair of adjustable shoulders respectively engaged with the housing teeth, the housing teeth being positioned on opposing sides of the housing. In a particular example, a cartridge neck is configured to be positioned between the pair of adjustable shoulders. In some examples, the firearm magazine can further include feed lips positionable adjacent to the upper periphery of the housing, wherein the adjustable shoulder includes a feed lip interface positioned adjacent to the feed lips. In specific implementations, the feed lips are positioned on top of the feed lip interface to maintain a positioning of the adjustable shoulder relative to the housing teeth. In some examples, the adjustable shoulder includes additional shoulder teeth disposed on a top portion of the adjustable shoulder; and the feed lips include feed lip teeth engageable with the additional shoulder teeth. In at least one example, the firearm magazine is a rotary magazine.

Another aspect of the present disclosure relates to a firearm magazine that includes: a housing; feed lips positioned on top of the housing; a position index located on at least one of the housing or the feed lips; and a movable stop engageable with the position index to position the movable stop at a plurality of positions within the housing, wherein when the movable stop is set at a position of the plurality of positions, the movable stop is configured to restrain forward axial movement of a cartridge via contact with a cartridge shoulder.

In some examples, the housing includes an upper periphery and a lower periphery; and the position index is located at both the upper periphery and the lower periphery. In one example, the position index includes teeth configured to positionally lock the movable stop when set at the position of the plurality of positions. In certain examples, the movable stop includes a first set of teeth disposed on a top portion of the movable stop and a second set of teeth disposed on a side portion of the movable stop.

Yet another aspect of the present disclosure relates to an adjustable insert for a firearm magazine. The adjustable insert can include: a contact surface to contact a cartridge shoulder; and an engagement interface positioned on a mating surface, the engagement interface being engageable with a portion of the firearm magazine, wherein the engagement interface includes a predetermined adjustment resolution for incrementally adjusting the adjustable insert forward and backward along a plane parallel to a longitudinal axis of the firearm magazine.

In some examples, the adjustable insert further includes a channel through which portions of a cartridge can move when a rotor of the firearm magazine guides the cartridge. In one or more examples, the channel includes an S-shaped channel. In at least one example, the adjustable insert further includes at least one shaft opening sized and shaped to receive a rotor shaft. In one example, the mating surface is positioned perpendicular to the contact surface. In particular examples, the engagement interface is a first engagement interface positioned on a side portion of the adjustable insert; and the engagement interface further includes a second engagement interface positioned on a top portion of the adjustable insert.

BRIEF DESCRIPTION OF THE DRAWINGS

The disclosure will be readily understood by the following detailed description in conjunction with the accompanying drawings, wherein like reference numerals designate like structural elements, and in which:

FIGS. 3-5A illustrate portions of a magazine housing that are engageable with an adjustable shoulder;

DETAILED DESCRIPTION

Reference will now be made in detail to representative aspects illustrated in the accompanying drawings. It should be understood that the following descriptions are not intended to limit the aspects to one preferred aspect. To the contrary, it is intended to cover alternatives, modifications, and equivalents as can be included within the spirit and scope of the described aspects as defined by the appended claims.

The following disclosure relates to a firearm magazine having an adjustable shoulder that can restrain forward axial movement of a cartridge via contact with a cartridge shoulder. The adjustable shoulder can be positioned at various different positions within the magazine to accommodate different types and sizes of cartridges. An adjustable shoulder (or movable stop or insert) can include a variety of different configurations, profiles, and structural relationships relative to the magazine. In some examples, the adjustable shoulder can include an elongated, thin tab that is positioned on one or both sides within the magazine housing. In other examples, the adjustable shoulder can include a block with a channel formed therein to allow a cartridge neck and bullet to extend through the block (but impede undesired forward travel of the cartridge shoulder). Depending on the type of adjustable shoulder, the adjustable shoulder can also include various different forms and/or configurations of engagement interfaces (or position indexes). Particular implementations of an engagement interface or position index include teeth (e.g., shoulder teeth that can engage corresponding housing teeth). Other engagement interfaces can include continuous (or near-continuous) adjustment resolution (e.g., via a screw-type or worm gear adjustment).

These and other aspects are discussed below with reference to FIGS. 1-24. However, those of ordinary skill in the art will readily appreciate that the detailed description given herein with respect to the FIGS. is for explanatory purposes only and should not be construed as limiting. Furthermore, as used herein, a system, a method, an article, a component, a feature, or a sub-feature including at least one of a first option, a second option, or a third option should be understood as referring to a system, a method, an article, a component, a feature, or a sub-feature that can include one of each listed option (e.g., only one of the first option, only one of the second option, or only one of the third option), multiple of a single listed option (e.g., two or more of the first option), two options simultaneously (e.g., one of the first option and one of the second option), or combination thereof (e.g., two of the first option and one of the second option).

Figure 1A:
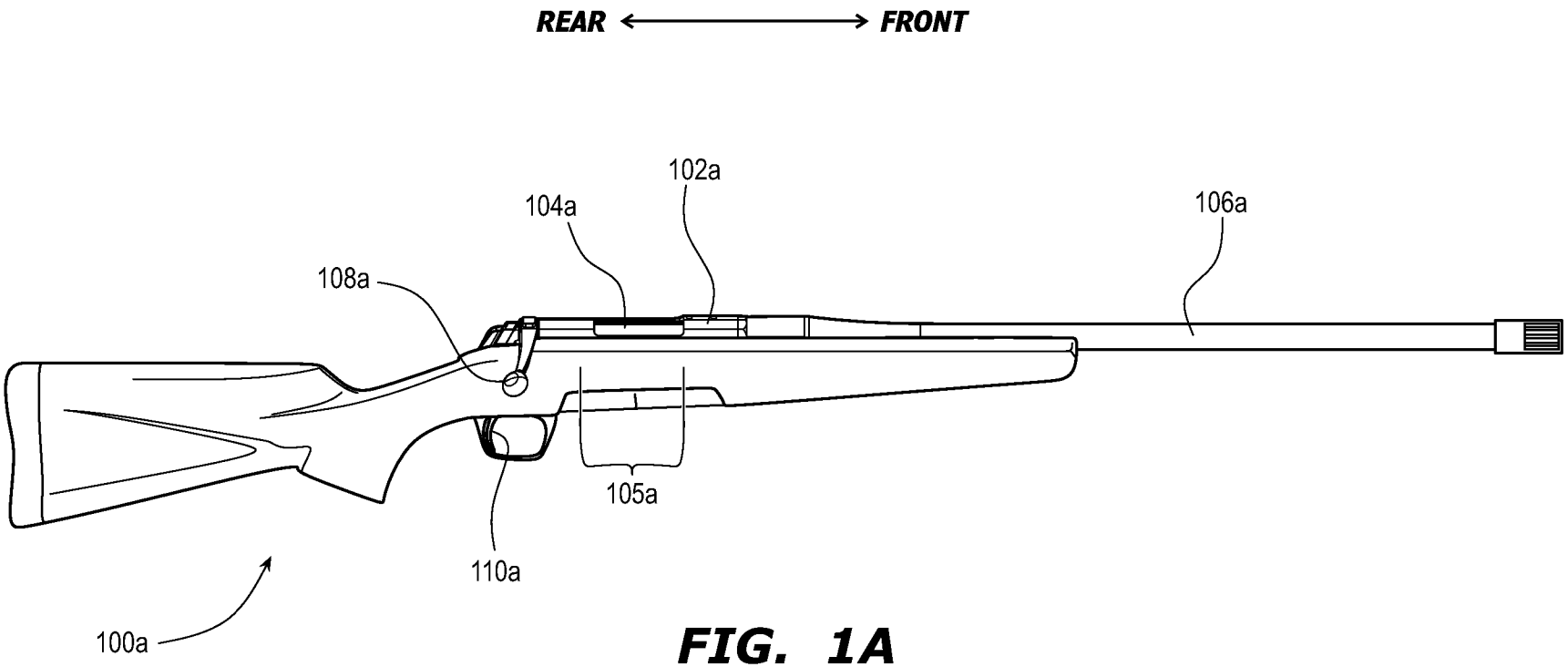
FIG. 1A illustrates a side view of an example firearm.

FIG. 1A illustrates an example of a firearm 100*a* in accordance with one or more aspects of the present disclosure. As used herein, the term "firearm" refers to any device configured to expel a projectile by way of an explosive element. In particular, a firearm includes a firing mechanism, such as a breech-loading firearm. Specific implementations of a firearm include bolt-action rifles. However, other implementations of a firearm are also herein contemplated, including firearms with different types of actions or cartridge cycling mechanisms. For instance, the firearm 100*a* can use gas, blow-forward, blowback or recoil energy to eject a case or chamber a cartridge (as done in some semi-automatic actions).

As shown, the firearm 100*a* includes a receiver 102*a*, a bolt 104*a*, a magazine 105*a*, a barrel 106*a*, a bolt handle 108*a*, and a trigger mechanism 110*a*. The receiver 102*a* includes a frame portion of the firearm 100*a*. The receiver 102*a* houses action components for breech loading, locking, firing, extracting, and ejecting an ammunition cartridge (hereafter "cartridge"). In particular aspects, the receiver 102*a* houses components for a bolt-action, such as the bolt 104*a*.

In one or more aspects, the bolt 104*a* includes elements for cycling a cartridge into a chamber of the barrel 106*a*. For example, the bolt 104*a* can catch and guide a cartridge from the magazine 105*a* into the chamber of the barrel 106*a*. Further, the bolt 104*a* can seal off the rear (breech-end) portion of the barrel 106*a* for discharging the firearm 100*a*. In this sealed-off firing position, the bolt 104*a* can support an applied axial load from recoil at the time of discharge. In addition, the bolt 104*a* can include one or more firing mechanisms, such as a firing pin that engages a primer portion of the cartridge. The bolt 104*a* can also include an extractor that hooks onto a rim of the cartridge case for pulling it out of the chamber of the barrel 106*a*. An ejector of the bolt 104*a* can then push the cartridge case out of an ejection port in the receiver 102*a*. The bolt 104*a* can include a myriad of different types and sizes of bolts.

The magazine 105*a* can include ammunition storage for one or more cartridges. In some examples, the magazine 105*a* can have a storage capacity of about two cartridges to about twenty cartridges, about three cartridges to about ten cartridges, or about five cartridges to about eight cartridges. In these or other examples, the magazine 105*a* can be sized and shaped to accommodate multiple different types and sizes of cartridges-including short-action, long-action, standard, and/or magnum cartridges. In some examples, the magazine 105*a* is a removable magazine (e.g., detachable and re-attachable to the firearm 100*a*). In other examples, the magazine 105*a* is a fixed magazine (e.g., formed integral to or otherwise non-removable from the firearm 100*a*).

Additionally, and as will be discussed more in relation to subsequent figures, the magazine 105*a* can include an adjustable shoulder. The adjustable shoulder can restrain the forward axial movement of a cartridge within the magazine 105*a*, particularly during recoil as the firearm 100*a* is fired. In these or other examples, the adjustable shoulder is positionally adjustable to accommodate different cartridges (e.g., a .308 WINCHESTER cartridge and a .260 REMINGTON) within the same magazine. Accordingly, the components of the magazine can be configured or assembled in various positions to properly accommodate different cartridges with various shoulder locations or geometries. Further, the magazine 105*a* can be a cross-cartridge compatible magazine, a universal magazine, etc.

The magazine 105*a* can also serve as a feeding device by facilitating the feeding of cartridges into the chamber of the firearm 100*a*. For example, the magazine 105*a* can properly position and orient a cartridge for engagement with the bolt 104*a* in a cycling (e.g., loading) process. To do so, the magazine 105*a* can implement various types of cartridge action through the magazine 105*a* via a follower, rotor, etc. Accordingly, the magazine 105*a* can include a single-stack configuration (with cartridges stacked one on top of the other in a substantially vertical column) implemented with a follower. Other follower implementations of the magazine 105*a* can include one or more columns of staggered (e.g., offset, unaligned) cartridges. Specific implementations—particularly follower implementations—of the magazine 105*a* can include multiple stacks or columns of cartridges (e.g., a double stack of cartridges). Alternatively, other examples of the magazine 105*a* can include a rotary-style configuration (with cartridges arranged in a curved or shaped column) implemented with one or more rotors.

The firearm 100*a* further includes the barrel 106*a*. The barrel 106*a* is connected to the receiver 102*a*. In one or more aspects, the barrel 106*a* receives a cartridge at a rearward portion. Once the firearm 100*a* is fired, a bullet is expelled out of the front portion (muzzle-end) of the barrel 106*a*. In certain implementations, the barrel 106*a* includes various attachments, such as a muzzle-break, suppressor, etc.

Additionally shown in FIG. 1, the firearm 100*a* includes a handle 108*a*. The handle 108*a* is attached to the bolt 104*a* (e.g., for manually cycling the bolt 104*a* to feed a cartridge into a chamber of the barrel 106*a* and/or eject a cartridge therefrom). The handle 108*a* can be positioned or oriented differently than illustrated (e.g., for left-handed users, various bolt-lift angles, etc.).

The firearm 100*a* further includes the trigger mechanism 110*a*. Via the trigger mechanism 110*a*, the firearm 100*a* can cause the firing pin of the bolt 104*a* to press into the primer of the cartridge for igniting the gun powder and explosively expelling a bullet through the barrel 106*a*.

Figure 1B:
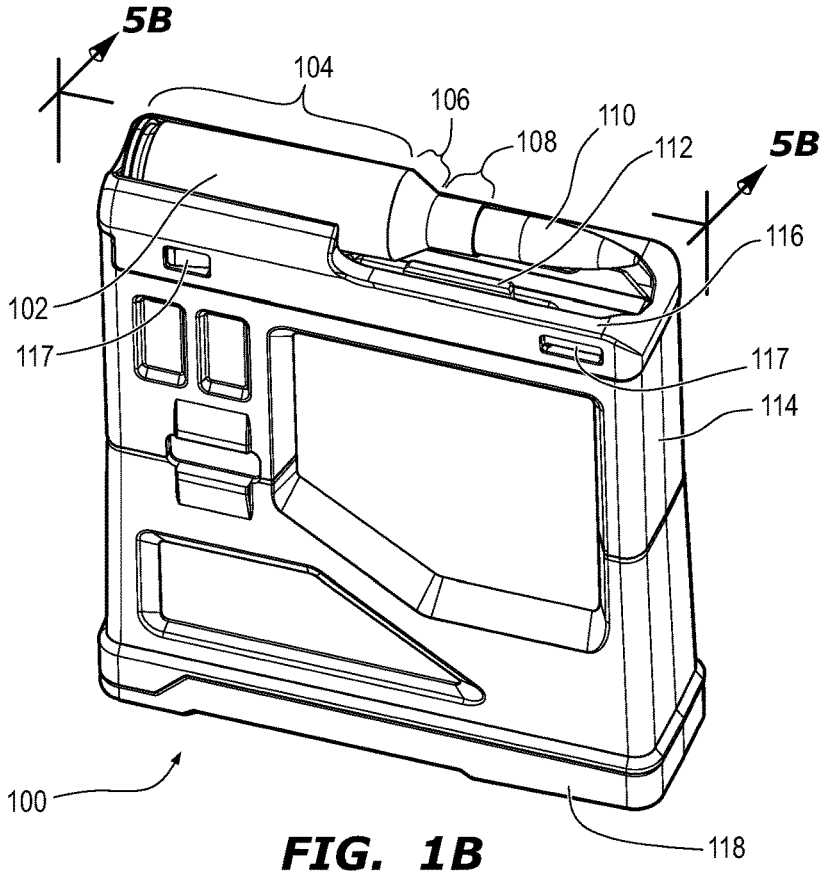
FIG. 1B illustrates a perspective view of an example magazine with an example cartridge.

FIG. 1B illustrates a perspective view of a magazine 100 in accordance with one or more examples of the present disclosure. The magazine 100 is one example implementation (e.g., a single-stack, follower configuration) of the magazine 105*a* shown and described above in relation to FIG. 1A. The magazine 700 (described below in relation to FIGS. 7-14) and the magazine 1500 (described below in relation to FIGS. 15-24) are additional example implementations of the magazine 105*a*.

As shown in FIG. 1B, the magazine 100 can include (e.g., store, position, orient, etc.) a cartridge 102. The cartridge 102 can include a body 104, a shoulder 106, a neck 108, and a bullet 110. The body 104 includes a portion of the cartridge 102 that is approximately cylindrical and typically largest in diameter relative to other cartridge portions. The shoulder 106 includes the tapered portion between the body 104 and the neck 108. The neck 108 includes an opening to receive the bullet 110, which is the projectile to be expelled from the cartridge 102 upon firing of the firearm 100*a*.

As mentioned above, the magazine 100 can include an adjustable shoulder 112. The adjustable shoulder 112 can also be referred to as a movable stop or an adjustable insert. The adjustable shoulder 112 can be positionally adjusted so as to abut, contact, or be positioned adjacent to the shoulder 106 of the cartridge 102. In so doing, the adjustable shoulder 112 can maintain a positioning of the cartridge 102 within the magazine 100 and thereby prevent the cartridge 102 from slamming into the front of the magazine 100 during recoil. Further, the adjustable shoulder 112 can be positionally adjusted to a desired positioning within the magazine 100. By being adjustable, the adjustable shoulder 112 can impart cross-cartridge compatibility. That is, a positioning of the shoulder 106 can vary to accommodate different cartridges, and the adjustable shoulder 112 can be correspondingly positioned to fit a desired caliber. Additional detail of the adjustable shoulder 112 is provided below in relation to FIGS. 5A-6C.

The magazine 100 can further include a housing 114. The housing 114 can include an enclosure, shell, hull, or container for holding one or more cartridges. In particular examples, the housing 114 can include a body portion of the magazine 100 that is sized and shaped to at least partially fit within the firearm 100*a*. The housing 114 can define an internal cavity within the magazine 100 in which the cartridge 102 (and other cartridges) can be stored.

The magazine 100 can also include feed lips 116. The feed lips 116 can be positioned on top of the housing 114. The feed lips 116 can define an opening into the cavity of the magazine 100. In some examples, the feed lips 116 includes a raised portion to engage (e.g., retain, intermittently contact, continuously abut) at least a portion of the body 104 of the cartridge 102. In some cases, the feed lips 116 can guide (e.g., center) the cartridge 102 as the bolt 104*a* cycles the cartridge 102 toward a feed ramp and into the chamber of the firearm barrel. In particular examples, the feed lips 116 are removable (e.g., via engagement of one or more release tabs 117 on the housing 114). Additionally, and as will be discussed more below, the feed lips 116 can positionally lock in place the adjustable shoulder 112 with respect to the housing 114.

In some examples, the magazine 100 can include a cover 118. The cover 118 can include a cap, lid, floor, or bottom portion that at least partially encloses a bottom opening of the housing 114. The cover 118 can, as will be discussed below, include one or more release buttons, tabs, or locks to remove the cover 118 from the housing 114.

Any of the features, components, and/or parts, including the arrangements and configurations thereof shown in FIGS. 1A-1B can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 1A-1B.

Figure 2A:
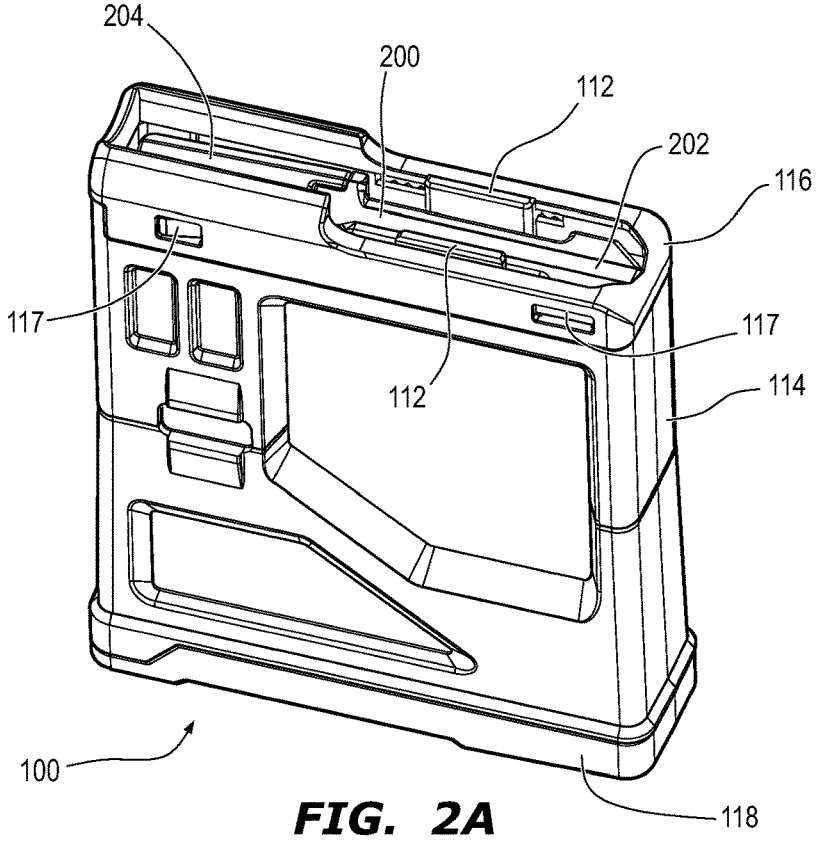
FIG. 2A illustrates a top perspective view of an example magazine.

As mentioned above, the magazine 100 can include a single-stack configuration in which cartridges are vertically arranged in a column. Such implementations can include a follower, as will now be discussed. FIG. 2A illustrates a top perspective view of the magazine 100 (without the cartridge 102) in accordance with one or more examples of the present disclosure. As shown, the magazine 100 can include a follower 200. The follower 200 can travel up and down as more or fewer cartridges are stored in the magazine 100. For example, the follower 200 can be compressed downward (i.e., pushed into the housing 114) upon insertion of a cartridge into the magazine 100. Likewise, upon removal of the cartridge from the magazine 100, the follower 200 can be biased upward (e.g., to an unbiased position or to a highest position against the lowest cartridge in the magazine 100).

In these or other examples, the follower 200 can ensure a proper positioning of the top-most cartridge in the magazine 100. For instance, the follower 200 can help ensure the top-most cartridge is situated at the proper height within the magazine 100 (e.g., abutting the feed lips 116 as shown in FIG. 1B) so that the bolt 104*a* can catch the cartridge and feed the cartridge into the barrel chamber. In addition, the follower 200 can help ensure the top-most cartridge has a proper angular orientation (e.g., a pitch angle) so that the cartridge does not have feeding issues during cycling. For instance, an improper pitch angle can cause the bullet-end of the cartridge to nose-dive into the housing 114 during cycling.

Those of ordinary skill in the art will appreciate that maintaining a proper positioning of the top-most cartridge in the magazine can be an increasingly difficult task as more cartridges are stored within a magazine. In particular, and as is often the case, the body 104 of the cartridge 102 can include taper between the primer-end of the body 104 (where the largest diameter of the body 104 typically is) and the shoulder-end of the body 104 (where the smallest diameter of the body 104 typically is). This taper in the body 104 of the cartridge 102 can lead to challenges for properly positioning the top-most cartridge in the magazine, particularly in a larger stack (i.e., count) of cartridges, such as ten cartridges.

To that end, the follower 200 of the present disclosure can include a rigid portion 202 and a flexible portion 204. In particular, the flexible portion 204 can accommodate for the amount of taper in the body 104 of the cartridge 102. In addition, the flexible portion 204 can accommodate for different amounts of taper for different cartridges without the need to create a custom follower for each cartridge. As an example, a stack of ten cartridges of .308 WINCHESTER produces a change in axis angle of about 6.2° in comparison to a stack of ten cartridges of 6.5 CREEDMOOR that produces a change in axis angle of only about 3.3°. The same follower 200 can account for both amounts of taper (and resultant deltas in pitch or axis angle from top-to-bottom cartridges) via the flexible portion 204.

In more detail, the rigid portion 202 can include a stiff, non-flexible region of the follower 200 that can apply a spring action force (from a magazine spring) to cartridges in a substantially perpendicular fashion. In contrast, the flexible portion 204 can move (e.g., rotate) relative to the rigid portion 202 to provide a flexible or variable-angle of bias against a cartridge. To illustrate, the flexible portion 204 can be compressed down with a larger stack of cartridges, and as the quantity of the cartridges in the stack decreases (or as the follower 200 moves upward within the housing 114), the flexible portion 204 can increasingly tilt upward relative to the rigid portion 202.

Figure 2B:
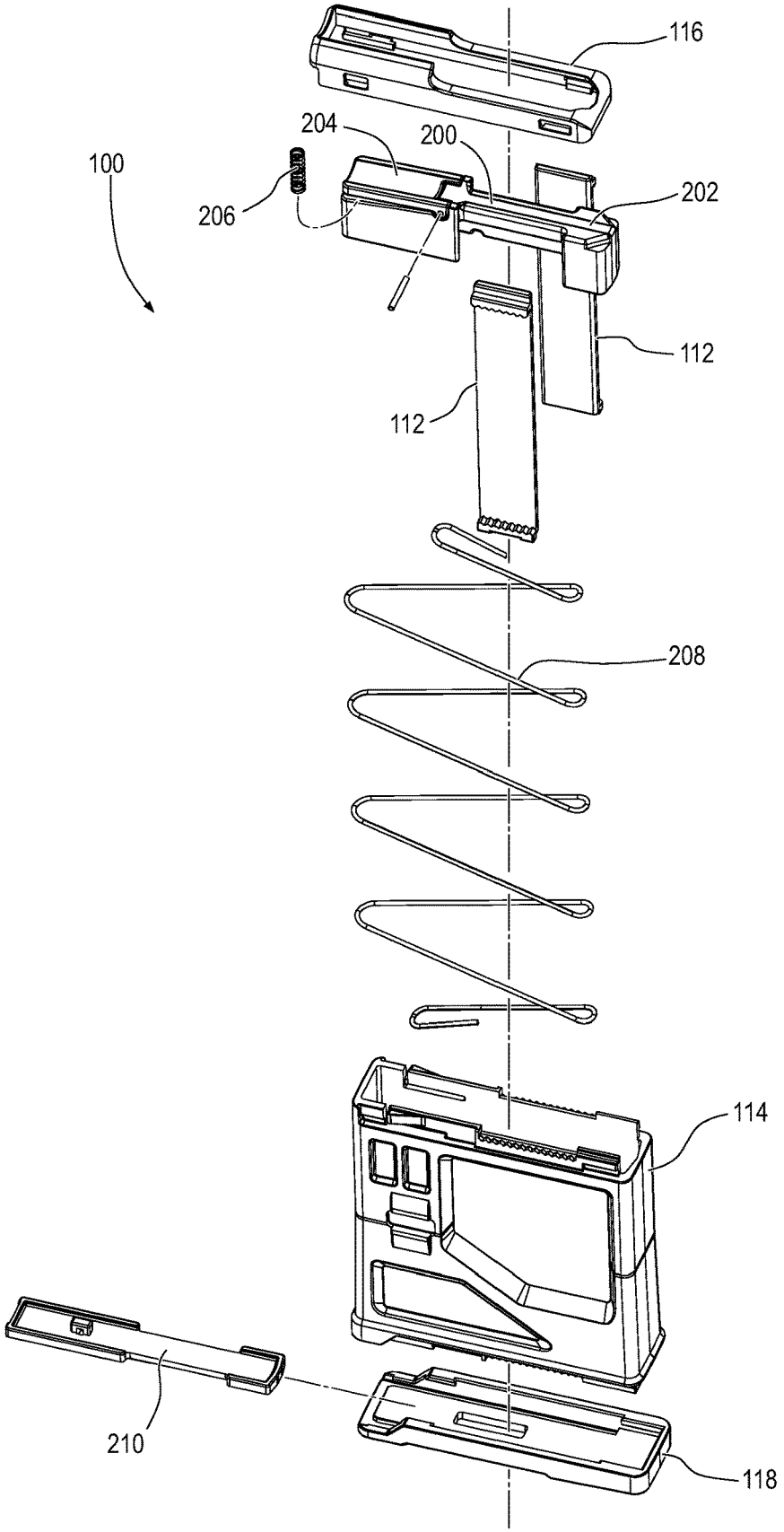
FIG. 2B illustrates an exploded view of an example magazine.

FIG. 2B shows an exploded view of the magazine 100 in accordance with one or more examples of the present disclosure. In particular, FIG. 2B additionally shows a spring 206 corresponding to the flexible portion 204 of the follower 200. In particular, the spring 206 can bias the flexible portion 204 upward (e.g., so as to accommodate for taper in the body of cartridges as discussed above). The spring 208 can bias the follower 200 upward as a whole, thereby pushing cartridges disposed in the magazine 100 upward for engaging with a bolt during the cycling process.

In addition, FIG. 2B shows the magazine 100 can include a cover lock 210. The cover lock 210 can be disposed between the cover 118 and the bottom opening of the housing 114. In some examples, the cover lock 210 maintain a positioning of the cover 118. For example, a protrusion on the bottom surface (not shown) of the cover lock 210 can engage a recess in the top surface of the cover 118, thereby preventing the cover 118 from inadvertently sliding horizontally out from the magazine 100.

Any of the features, components, and/or parts, including the arrangements and configurations thereof shown in FIGS. 2A-2B can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 2A-2B.

Figure 3:
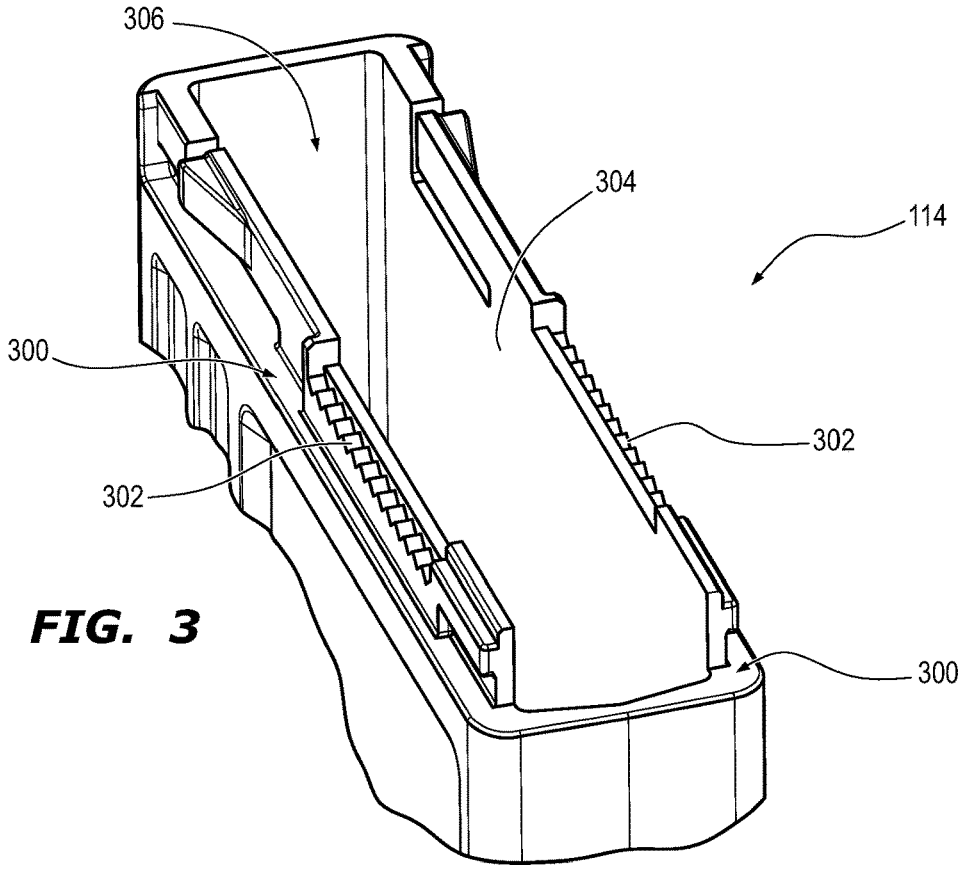
Figure 4:
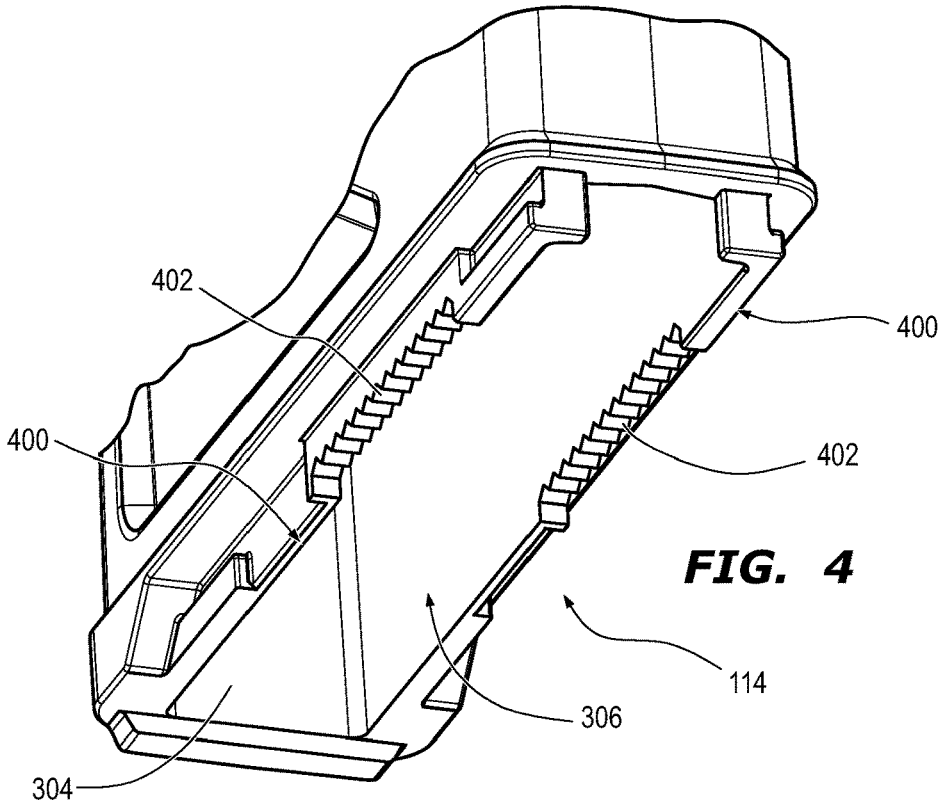

As mentioned above, a magazine of the present disclosure can include shoulder retention. In particular examples, the shoulder retention element can engage portions of the magazine housing, as will now be discussed. FIGS. 3-5 illustrate portions of a magazine housing that are engageable with an adjustable shoulder in accordance with one or more examples of the present disclosure.

In particular, FIG. 3 illustrates a top perspective view of an upper portion of the housing 114. As shown, the housing 114 can include an upper periphery 300. The upper periphery 300 can include an upper edge or top lip that defines a top opening into a cavity 306 of the housing 114. In certain examples, the upper periphery 300 can abut or be positioned adjacent to the feed lips 116. In particular implementations, the upper periphery 300 can slidably engage (and lock in place) the feed lips 116.

More particularly, the upper periphery 300 can include housing teeth 302. In some examples, and as shown, the housing teeth 302 are positioned on opposing sides of the upper periphery 300. Alternatively, the housing teeth 302 are positioned on a single side of the upper periphery 300.

The housing teeth 302 can include a series of teeth, ridges, bumps, slots, crests, troughs, etc. The housing teeth 302 can include a tooth spacing (e.g., an inter-tooth spacing measured between peaks or teeth) that allows for a desired adjustment resolution. As an example, the housing teeth 302 can include a tooth spacing that ranges from about 0.5 mm to about 5 centimeters, about 1 mm to about 1 centimeter, or about 1.5 mm to about 20 mm. In these or other examples, a larger tooth spacing can provide fewer positional settings for an adjustable shoulder in comparison to a smaller tooth spacing. In addition, the housing teeth 302 can include a tooth height that disallows (or helps reduce a likelihood of)

undesired displacement of the adjustable shoulder during recoil impact with a cartridge. Thus, increased tooth height can increase a surface area and thus increase an amount of impact load the adjustable shoulder can take without movement relative to the housing teeth 302. As will be shown below, the housing teeth 302 can correspond to shoulder teeth (which can have a corresponding tooth spacing and tooth height).

It will be appreciated that the housing teeth 302 is but one example of a position index or engagement interface. That is, the housing teeth 302 is one example implementation of a position index or engagement interface that can control, adjust, and/or maintain a position of an adjustable shoulder relative to the housing 114. For example, a position index or engagement interface can include a gear interface (e.g., a rack-and-pinion interface, a worm gear interface), a set screw interface, snap-action mechanisms, linear actuators, fine adjustment mechanisms, clamping mechanisms, ratchets, escapements, indexing mechanisms (e.g., that convert rotating, rocking or oscillatory motion to a series of step movements of an output link or shaft), swinging or rocking mechanisms, reciprocating mechanisms, reversing mechanisms, couplings and connector mechanisms, sliding connector mechanisms, etc. In these or other examples, a position index or engagement interface of the present disclosure can include a wide variety of adjustment resolution, including continuous (or near-continuous adjustment resolution).

Additionally shown in FIG. 3, in some examples, an interior surface 304 of the housing 114 defines the metes and bounds of the cavity 306 where the cartridge(s) are stored. In these or other examples, the cavity 306 is sized and shaped to fit a wide variety of cartridges and cartridge sizes. Additionally, the interior surface 304 can extend between the upper periphery 300 and a lower periphery 400 (shown and described below in relation to FIG. 4).

FIG. 4 depicts a bottom perspective view of a lower portion of the housing 114. In particular, FIG. 4 shows the housing 114 can include a lower periphery 400 with housing teeth 402. In some examples, and as shown, the housing teeth 402 are positioned on opposing sides of the lower periphery 400. Alternatively, the housing teeth 402 are positioned on a single side of the lower periphery 400.

The lower periphery 400 can include a lower edge or bottom lip that defines a bottom opening into the cavity 306 of the housing 114. The lower periphery 400 can also contact or be positioned adjacent to the cover 118. In particular implementations, the lower periphery 400 can slidably engage (and lock in place) the cover 118.

In these or other examples, the housing teeth 402 can be the same as or similar to the housing teeth 302 discussed above. In addition, the housing teeth 402 can be vertically aligned with the housing teeth 302 on the upper periphery 300, thereby allowing the same adjustment of the adjustable shoulder at both top and bottom ends of the housing 114. The housing teeth 402 can, like the housing teeth 302, alternatively include other forms of a position index or engagement interface as described above.

Figure 5A:
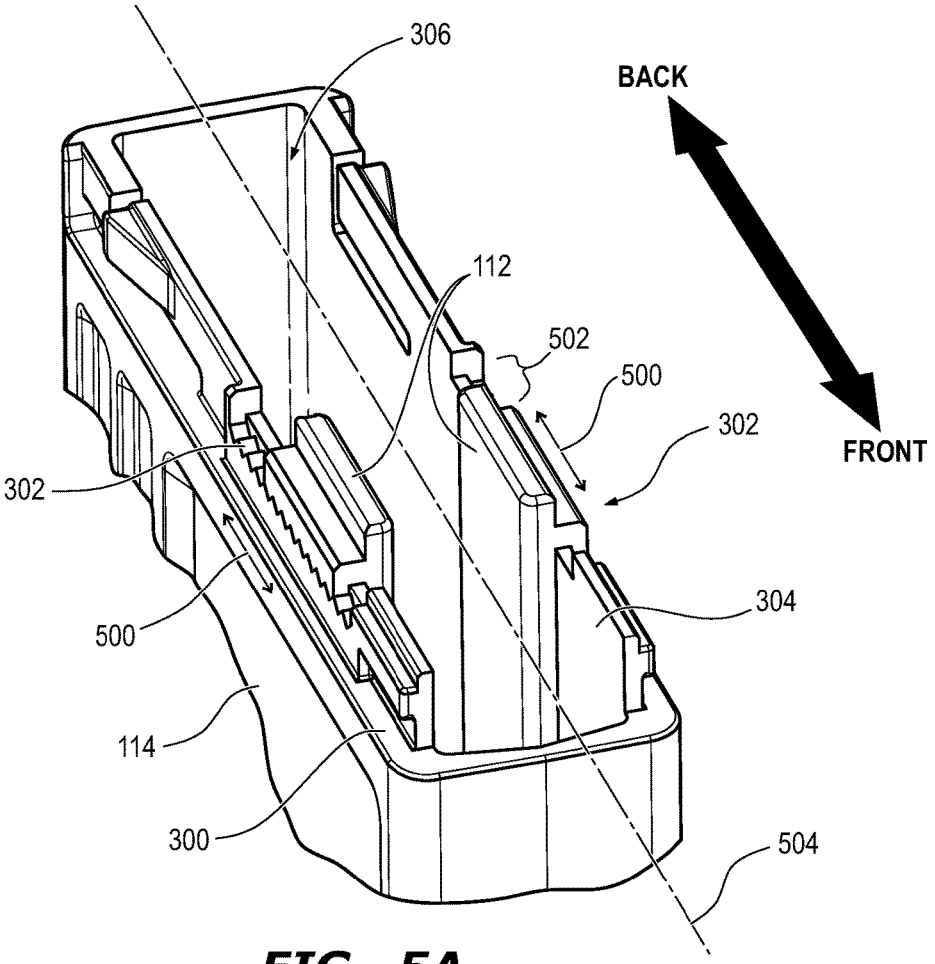

FIG. 5A illustrates another top perspective view of an upper portion of the housing 114 (like in FIG. 3), but with the addition of the adjustable shoulders 112. As shown in FIG. 5A, the adjustable shoulders 112 can be adjusted along directions 500 to engage the housing teeth 302 at different positions. The directions 500 correspond to forward and backward axial directions along a plane that is parallel to a longitudinal axis 504 extending horizontally through the center of the magazine 100 from front-to-back. In other terms, the directions 500 correspond to translation directions of the adjustable shoulder 112, which are parallel or approximately parallel to the axis of a cartridge (not shown) housed within the magazine 100.

With the feed lips 116 removed (as shown in FIG. 5A), the adjustable shoulder 112 can be manually adjusted as desired (e.g., by picking up the adjustable shoulder 112 to disengage the adjustable shoulder 112 from the housing teeth 302 and move the adjustable shoulder 112 along either of the directions 500). Additionally, with the feed lips 116 removed, the adjustable shoulder 112 can also be entirely removed from the housing 114 (e.g., for cleaning, disassembly, inspection, etc.). Similarly, the adjustable shoulder 112 can be interchanged with new/repaired adjustable shoulders or different adjustable shoulders (e.g., for additional or alternative cartridge compatibility).

Upon placement of the feed lips 116 over the adjustable shoulders 112 (as shown in FIGS. 1B and 2A), the feed lips 116 can maintain a positioning of the adjustable shoulders 112 relative to the housing teeth 302. That is, the feed lips 116 can prevent up-down movement of the adjustable shoulders 112, and the housing teeth 302 can positionally lock the adjustable shoulders in the directions 500 at a given position of a plurality of positions along the housing teeth 302. In addition, the interior surface 304 can extend above the housing teeth 302 to disallow lateral inward displacement of the adjustable shoulder 112 away from the housing teeth 302. Each adjustable shoulder 112 can therefore be fully positionally constrained (upward by the feed lips 116, frontwards and backwards by the housing teeth 302, and inward by the interior surface 304).

Any of the features, components, and/or parts, including the arrangements and configurations thereof shown in FIGS. 3-5A can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 3-5A.

Figure 5B:
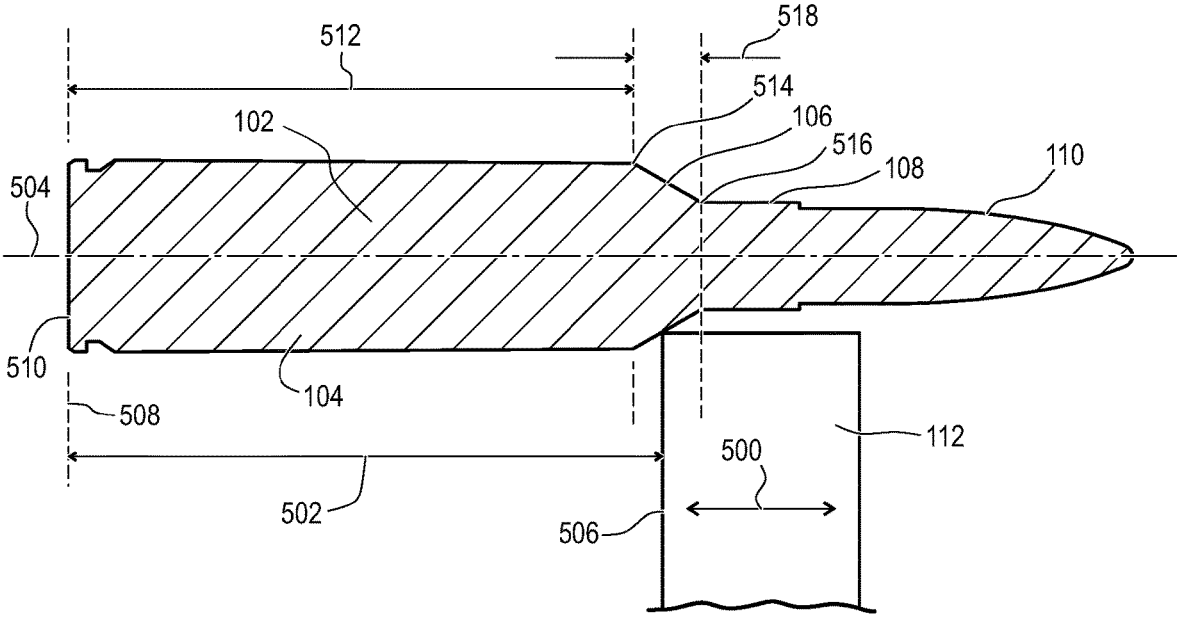
FIG. 5B illustrates a cross-sectional side view of a cartridge relative to an adjustable shoulder of a magazine.

FIG. 5B illustrates a cross-sectional side view of a cartridge relative to the adjustable shoulder 112 of a magazine in accordance with one or more examples of the present disclosure. As the adjustable shoulder 112 on each side is adjusted in the directions 500, a corresponding axial shoulder spacing 502 can be adjusted. That is, forward adjustment of the adjustable shoulder 112 toward the front of the housing 114 (not illustrated in FIG. 5B) can increase the axial shoulder spacing 502. Conversely, backward adjustment of the adjustable shoulder 112 toward the back of the housing 114 can decrease the axial shoulder spacing 502. The axial shoulder spacing 502 can therefore be adjusted to accommodate different cartridge sizes (and therefore different shoulder positions of different cartridges) within a magazine. In these or other examples, the axial shoulder spacing 502 can be defined as the axial distance along the longitudinal axis 504 measured from a contact surface 506 of the adjustable shoulder 112 to a back plane 508 corresponding to a rim 510 of the cartridge 102. The contact surface of the adjustable shoulder 112 is discussed below in relation to contact surface 606 in FIGS. 6A-6C.

It will be appreciated that the axial shoulder spacing 502 can be advantageously adjusted to accommodate many different cartridge sizes-particularly to impart compatibility with a body length 512 of the cartridge 102 that can vary widely across cartridge sizes and families of cartridge geometries. The body length 512 can be measured from the back plane 508 of the cartridge 102 to a back shoulder edge 514.

Similarly, the axial shoulder spacing 502 can be adjusted to accommodate many different geometries of the shoulder 106. For instance, the cartridge 102 can have a shoulder length 518 that varies widely across cartridge sizes and families of cartridge geometries. The shoulder length 518 can be measured from the back shoulder edge 514 to a front shoulder edge 516 at which the neck 108 begins. Additionally or alternatively, in some examples, the axial shoulder spacing 502 can be adjusted to accommodate different shoulder angles (i.e., slope or rate of taper) for the shoulder 106.

Any of the features, components, and/or parts, including the arrangements and configurations thereof shown in FIG. 5B can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIG. 3-5B.

Additional detail with respect to the adjustable shoulder 112 will now be discussed in relation to FIGS. 6A-6C. In particular, FIGS. 6A-6C respectively illustrate perspective, front, and side views of the adjustable shoulder 112 in accordance with one or more examples of the present disclosure. As shown, the adjustable shoulder 112 can include an upper portion 600*a* and a lower portion 600*b*. At least one of the upper portion 600*a* or the lower portion 600*b* can include a mating surface (i.e., mating surfaces 602*a*, 602*b*) to engage with the housing 114. In some examples, the adjustable shoulder 112 can include a more robust or impact resistant design by including respective mating surfaces 602*a*, 602*b* at both the upper and lower portions 600*a*, 600*b*. For example, by additionally having the mating surface 602*b* at the lower portion 600*b*, the adjustable shoulder 112 can better withstand a torsional load or bending moment induced during recoil impact with the cartridge shoulder (which occurs at the contact surface 606 positioned only at the upper portion 600*a* as discussed below).

As used herein, the term mating surface can refer to a surface portion of the adjustable shoulder 112 that can contact, hold, grip, interlock with, or otherwise retain a portion of the housing 114, such as the housing teeth 302 and/or the housing teeth 402 discussed above. The mating surfaces 602*a*, 602*b* can include a variety of different types of engagement to mate with corresponding areas of the housing 114. As shown, the mating surfaces 602*a*, 602*b* can respectively include shoulder teeth 604*a*, 604*b* (e.g., to engage the housing teeth 302 and the housing teeth 402). The shoulder teeth 604*a*, 604*b* can be the same as or similar to the housing teeth 302 or the housing teeth 402 discussed above, except positioned on the mating surfaces 602*a*, 602*b* of the adjustable shoulder 112. Alternatively, the mating surfaces 602*a*, 602*b* can include other types of an engagement interface to engage the housing 114. For example, other types of engagement interfaces on the mating surfaces 602*a*, 602*b* can include a gear interface (e.g., a rack-and-pinion interface, a worm gear interface), a set screw interface, snap-action mechanisms, linear actuators, fine adjustment mechanisms, clamping mechanisms, ratchets, escapements, indexing mechanisms (e.g., that convert rotating, rocking or oscillatory motion to a series of step movements of an output link or shaft), swinging or rocking mechanisms, reciprocating mechanisms, reversing mechanisms, couplings and connector mechanisms, sliding connector mechanisms, etc.

Further shown, the mating surface 602*a* (and corresponding shoulder teeth 604*a*) are spaced apart from an interior-facing side 612 (which is positionable immediately adjacent to the interior surface 304 of the housing 114), thereby defining an overhang and associated gap. In these or other examples, the interior surface 304 of the housing 114 can extend into the gap between the overhang and the interior-facing side 612 (as shown in FIG. 5A). In so doing, the overhang of the mating surface 602*a* can disallow inward displacement of the shoulder teeth 604*a* away from the housing teeth 302.

Additionally, the upper portion 600*a* of the adjustable shoulder 112 can include a contact surface 606. A contact surface can include a stop surface, catch, hook, or interference element configured to contact, block, or otherwise impinge against a cartridge shoulder (particularly during recoil). The contact surface 606 can include a variety of different shapes and profiles. In particular examples, the contact surface 606 extends upward relative to a feed lip interface 608 (or shelf) that can support, contact, or be positioned adjacent to the feed lips 116. In this way, the contact surface 606 can protrude above the feed lips 116 (as shown in FIGS. 1B and 2A) to contact a cartridge shoulder. In more detail, the contact surface 606 is perpendicular to other surfaces of the adjustable shoulder 112 (including at least one of the interior-facing side 612, the mating surface 602*a*, or the feed lip interface 608). In certain implementations, the contact surface 606 can include a reinforced (e.g., hardened) portion of the adjustable shoulder 112, a cushioned portion of the adjustable shoulder 112, an overmolded portion of the adjustable shoulder 112, etc. In one example, the contact surface 606 includes a wear bar (e.g., an elastomeric pad or colored indicator to visually indicate wear). Further, it will be appreciated that the adjustable shoulder 112 can be positioned on either side of the housing 114. Indeed, either contact surface 606 can be used to abut a cartridge shoulder (depending on which housing side the adjustable shoulder 112 is positioned).

Similar to the feed lip interface 608, the lower portion 600*b* can include a cover interface 610. The cover interface 610 can support, contact, or be positioned adjacent to the cover 118. In some examples, the cover interface 610 is positioned below the mating surface 602*b* (e.g., on a bottom end of the adjustable shoulder 112). When the cover 118 is positioned over the cover interface 610, the cover 118 can also lock in place (i.e., positionally constrain) the lower portion 600*b* relative to the housing 114.

Figure 6A:
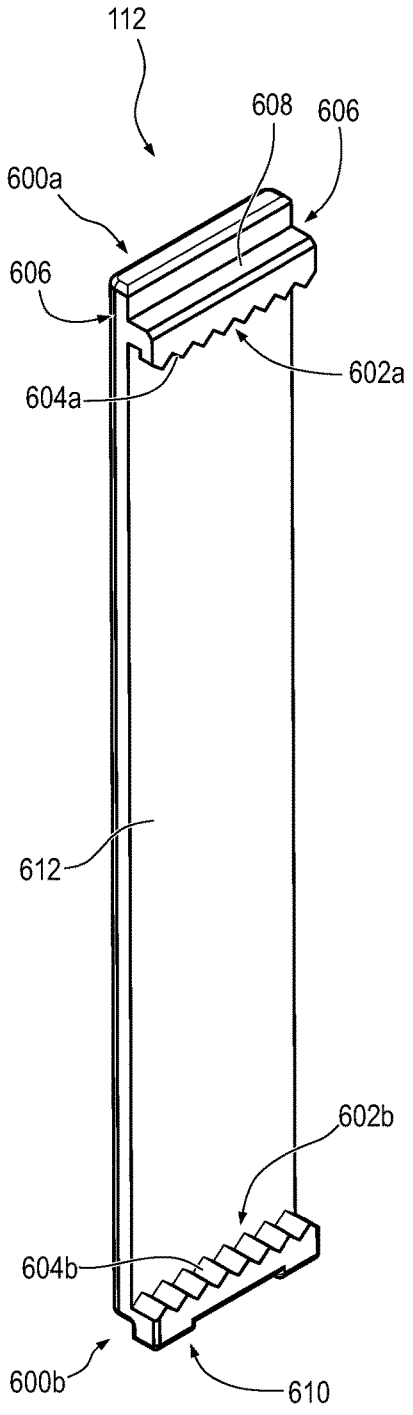
FIGS. 6A-6C respectively illustrate perspective, front, and side views of an example adjustable shoulder.
Figure 6B:
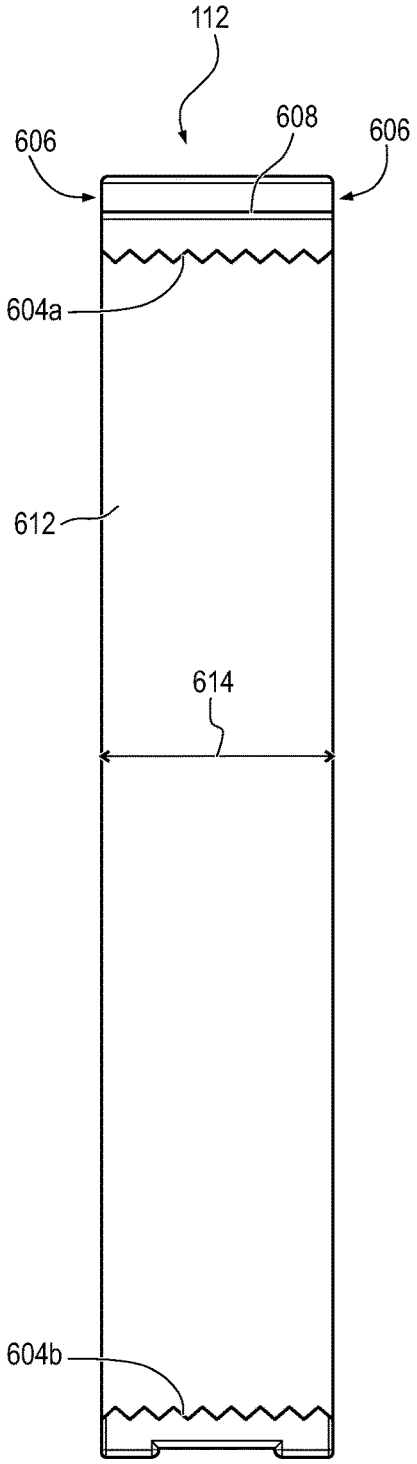
Figure 6C:
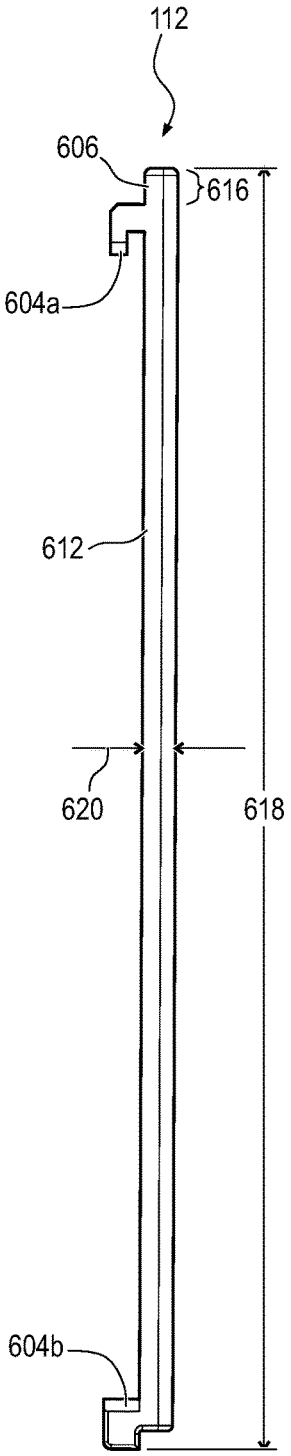

FIGS. 6A-6C further show the adjustable shoulder 112 has a length 614, a height 618, and a thickness 620. In these or other examples, the length 614 can correspond to a ratio (e.g., about 10 percent to about 50 percent of the magazine length, about 15 percent to about 40 percent of the magazine length, or about 20 percent to about 30 percent of the magazine length). Additionally, the height 618 can correspond approximately to a height of the housing 114. A portion of the height 618 that extends above the housing height includes an extension 616 of the contact surface 606 (e.g., for contacting a cartridge shoulder above the feed lips 116). Further, the thickness 620 can depend on the size of the cavity 306 in the housing 114. The thickness 620 can be sufficiently thick so that the adjustable shoulder 112 contacts the cartridge shoulders, but not too thick so as to impede travel of the follower 200 (or otherwise prevent the neck and bullet portions of the cartridge from traveling through the magazine 100 between the pair of adjustable shoulders 112.

Any of the features, components, and/or parts, including the arrangements and configurations thereof shown in FIGS. 6A-6C can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 6A-6C.

As mentioned above, a magazine of the present disclosure can include adjustable shoulders that are implemented in a wide variety of magazine types, including rotary magazines. The remaining description and associated FIGS. 7-24 discuss such example implementations. In particular, the following discussion in relation to FIGS. 7-14E describes various example implementations of a dual-rotary magazine. Further discussion in relation to FIGS. 15-24 describes various example implementations of a single-rotary magazine.

Figure 7:
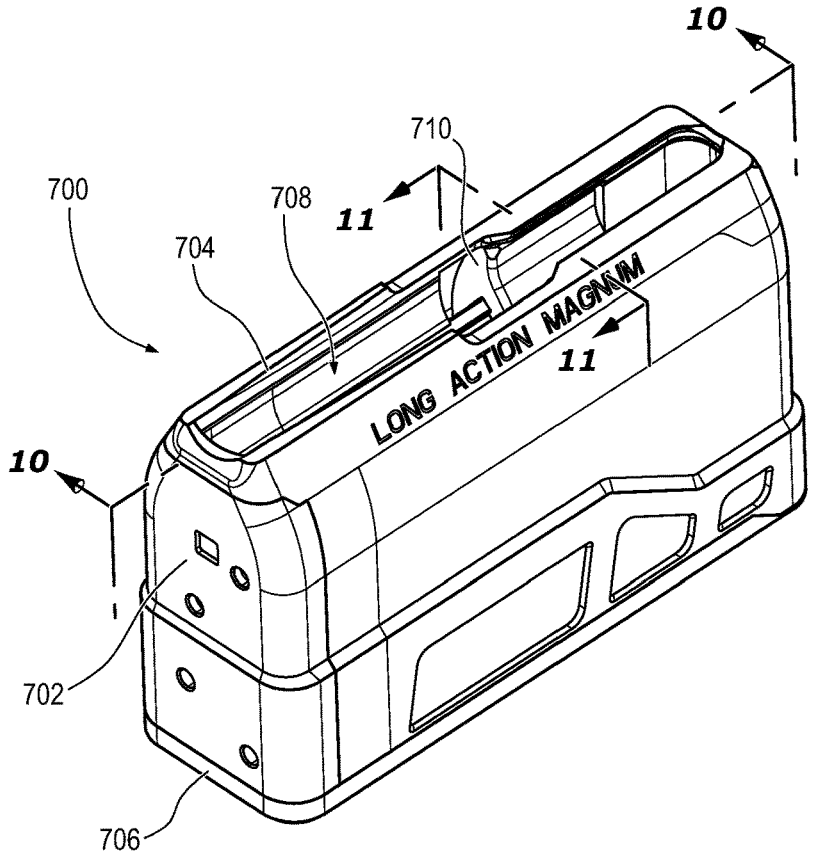
FIGS. 7-9 respectively illustrate top perspective, bottom perspective, and exploded views of another example magazine.
Figure 8:
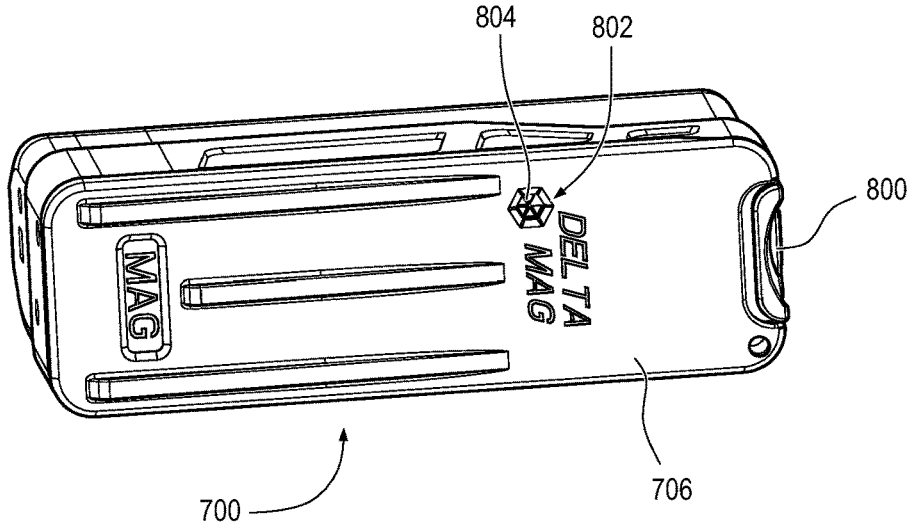
Figure 9:
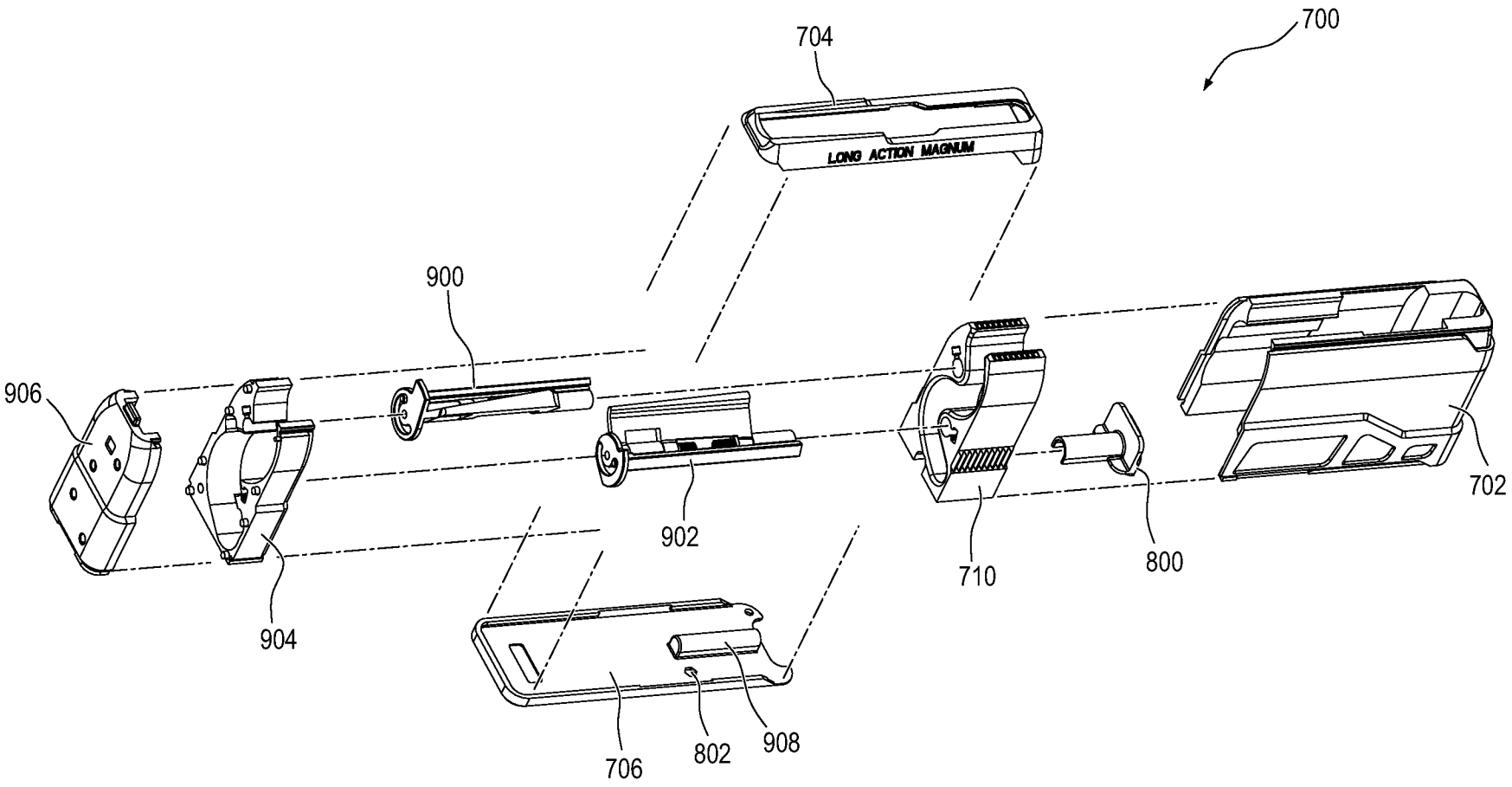

FIGS. 7-9 respectively illustrate top perspective, bottom perspective, and exploded views of a magazine 700 in accordance with one or more examples of the present disclosure. The magazine 700 can be the same as or similar to the magazine 105*a* discussed above in relation to FIG. 1A. Additionally or alternatively, the magazine 700 can include one or more of the same or similar features discussed above in relation to the magazine 100. As shown, the magazine 700 can include a housing 702, feed lips 704, a cover 706, a cavity 708, and an adjustable shoulder 710. The housing 702 can be the same as or similar to the housing 114 discussed above. The feed lips 704 can be the same as or similar to the feed lips 116 discussed above. The cover 706 can be the same as or similar to the cover 118 discussed above. The cavity 708 can be the same as or similar to the cavity 306 discussed above. The adjustable shoulder 710 can also be functionally similar to the adjustable shoulder 112 discussed above, but with structural differences for accommodating dual-rotor action in the magazine. Additional detail for the adjustable shoulder 710 is thus provided below in relation to FIGS. 11 and 14A-14E.

FIG. 8 further shows the cover 706 can include a cover release 800 and an indicator window 802. The cover release 800 can be actuated (e.g., via a button press or mash) to disengage the cover 706 from the housing 702. Alternatively, the cover release 800 can include depressible tabs (e.g., similar to the release tabs 117 shown in FIG. 1B for the feed lips 116), fasteners, etc.

In some examples, the indicator window 802 can include an opening, aperture, or a transparent area that allows visibility through the cover 706. In these or other examples, the indicator window 802 can align with an indicator 804 positioned on a bottom side of the adjustable shoulder 710. The indicator 804 can include a variety of different colors, markings, indicia, codes, symbols, arrows, shapes, etc. that represent a particular positioning of the adjustable shoulder 710 within the magazine 700.

Figure 14A:
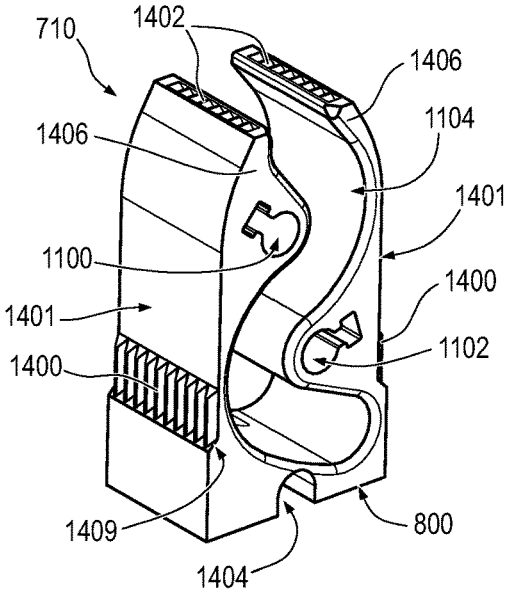
FIGS. 14A-14E illustrate various view of another example adjustable shoulder.
Figure 14B:
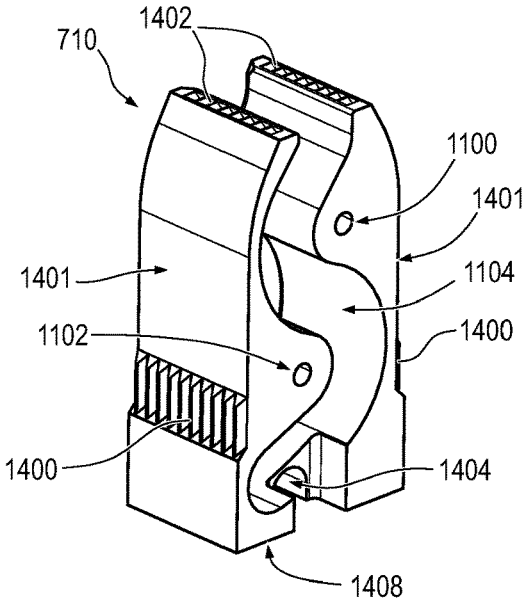
Figure 14C:
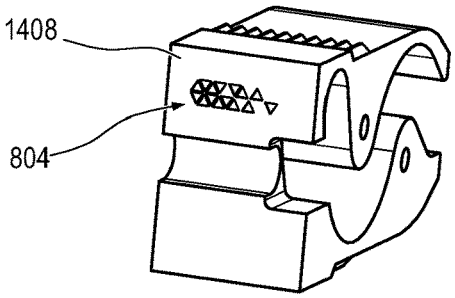

Additionally, it will be appreciated that the indicator 804 can serve as a visual confirmation to a user that the adjustable shoulder 710 is properly positioned for the desired cartridge. For example, a certain number of triangles as the indicator 804 (when viewed through the indicator window 802) can indicate a positioning of the adjustable shoulder 710 corresponds to a set range of calibers, cartridge shoulder measurements, etc. Likewise, a different number of triangles as the indicator 804 (when viewed through the indicator window 802) can indicate a different positioning of the adjustable shoulder 710 corresponds to a different range of calibers, different cartridge shoulder measurements, etc. A more complete view of the indicator 804 associated with different adjustable shoulder positions within the magazine 700 is shown in FIG. 14C.

FIG. 9 further illustrates a first rotor 900 and a second rotor 902. The first rotor 900 and the second rotor 902 can cooperate with each other to move cartridges through the magazine 700. For example, the first rotor 900 and the second rotor 902 are positioned adjacent to each other and can rotate in predetermined directions so that the cartridges can travel through the magazine along a curved path. In specific implementations, the first rotor 900 can rotate counter-clockwise to move cartridges through an upper portion of the magazine 700, and the second rotor 902 can rotate clockwise to move cartridges from a lower portion of the magazine 700 to the upper portion (where the first rotor 900 takes over). In these or other examples, the first rotor 900 and the second rotor 902 can be torsionally biased (e.g., via torsion springs) to provide a desired rotation.

Additionally, end portions of the first rotor 900 and the second rotor 902 can be mounted within a head 906 of the housing 702. In some examples, the head 906 can include stop surfaces to engage (i.e., limit or bound rotation of) the end portions of the first rotor 900 and the second rotor 902. Further, the first rotor 900 and the second rotor 902 can be rotationally bound by a bracket 904, which can include one or more surfaces to engage (e.g., abut or contact) associated rotor blades of the first rotor 900 and the second rotor 902. Additionally or alternatively, in some examples, the bracket 904 can be a mounting bracket or assembly bracket for assembling the head 906 to the housing 702 post-assembly of the first rotor 900 and the second rotor 902 within the magazine 700.

Any of the features, components, and/or parts, including the arrangements and configurations thereof shown in FIGS. 7-9 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 7-9.

Figure 10:
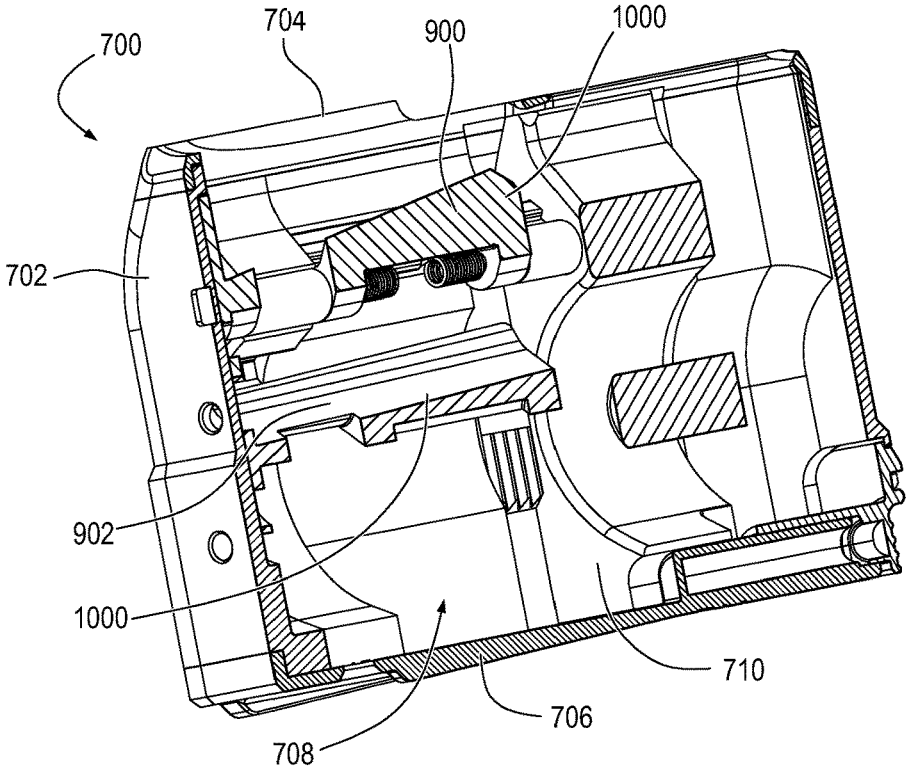
FIGS. 10-11 respectively illustrate lengthwise and widthwise cross-sections of an example magazine.
Figure 11:
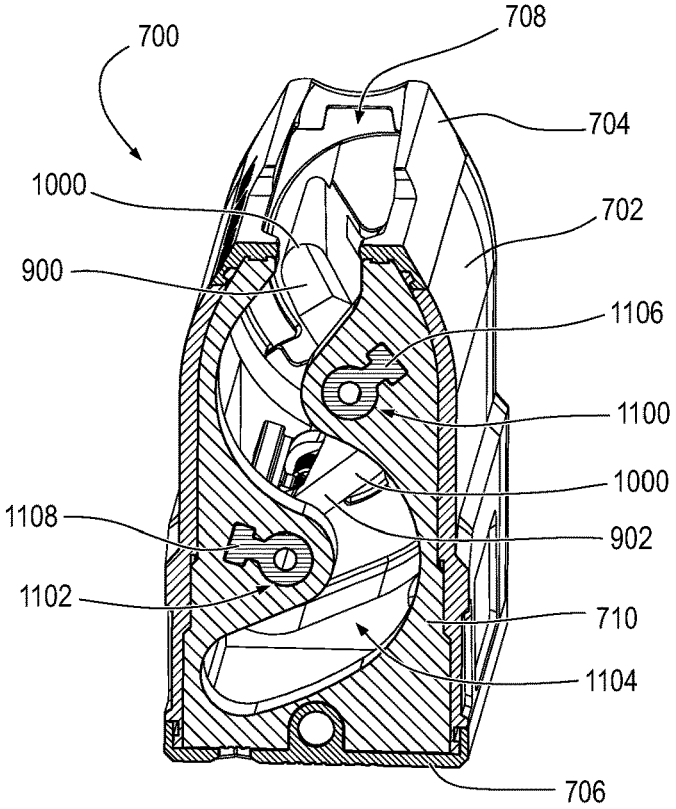

FIGS. 10-11 respectively illustrate lengthwise and widthwise cross-sections of the magazine 700 in accordance with one or more examples of the present disclosure. FIG. 11 in particular is a cross-section taken widthwise through the adjustable shoulder 710. As seen in these figures, the first rotor 900 and the second rotor 902 can be vertically offset from one another so that respective rotor blades 1000 of the first rotor 900 and the second rotor 902 can rotatably sweep cartridges in a curved path (e.g., an "S"-shaped path). As seen in FIG. 11, for example, the first rotor 900 and the second rotor 902 can move cartridges through a channel 1104 defined by the adjustable shoulder 710. The channel 1104 can include a through-slot in which a cartridge neck and bullet can travel (but not the cartridge shoulder).

The adjustable shoulder 710 can further include shaft openings 1100, 1102 corresponding to the shaft 1106 of the first rotor 900 and the shaft 1108 of the second rotor 902, respectively. In at least some examples, the shafts 1106, 1108 are positionally fixed relative to the adjustable shoulder 710. In contrast, the first rotor 900 and the second rotor 902 (and in particular, the associated rotor blades 1000) can rotate relative to the adjustable shoulder 710.

Any of the features, components, and/or parts, including the arrangements and configurations thereof shown in FIGS. 10-11 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 10-11.

Figure 12:
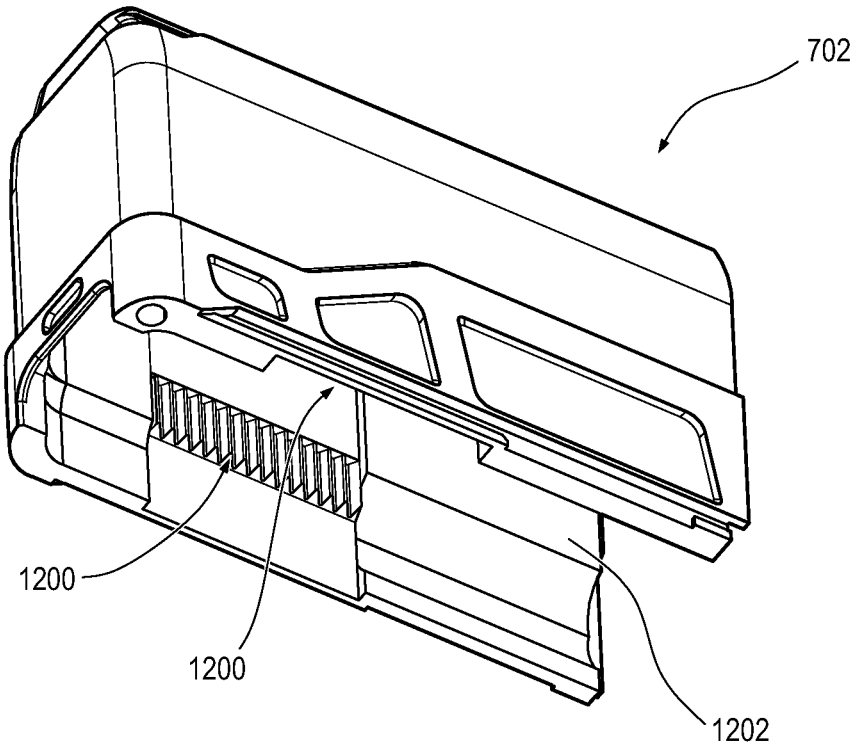
FIG. 12 illustrates a bottom perspective view of an example magazine housing.

As mentioned above, the housing of a magazine can engage an adjustable shoulder. The housing can include many different configurations of an engagement interface or position index to engage the adjustable shoulder. In particular implementations, an interior surface of the housing can engage an adjustable shoulder. FIG. 12 illustrates a bottom perspective view of the housing 702 having housing teeth 1200 in accordance with one or more examples of the present disclosure.

As shown in FIG. 12, the housing teeth 1200 are positioned on an interior surface 1202 (rather than an upper or lower periphery as in the magazine 100). Albeit limited by the illustrated view, the housing teeth 1200 can be positioned on both opposing sides of the interior surface 1202 (e.g., so as to engage opposite sides of the adjustable shoulder 710, such as side shoulder teeth 1400 discussed below in relation to FIGS. 14A, 14B, and 14D). Further, in some examples, the housing teeth 1200 can be positioned (and dimensioned) to provide a wide variety of different positions for the adjustable shoulder 710. In this way, the adjustable shoulder 710 can be adjusted relative to the housing 702 to accommodate a host of different calibers (and associated cartridge shoulder positions) within the magazine 700. Other types of engagement interfaces or position indices besides the housing teeth are herein contemplated, as discussed above.

Any of the features, components, and/or parts, including the arrangements and configurations thereof shown in FIG. 12 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIG. 12.

Figure 13:
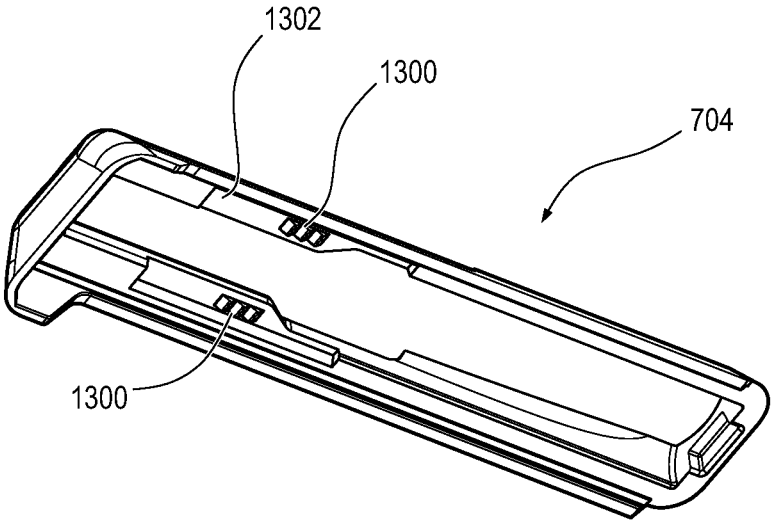
FIG. 13 illustrates a bottom perspective view of example feed lips.

In some implementations, the feed lips 704 can include an engagement interface or position index (in addition to or alternatively to the housing 702). In accordance with one or more such examples, FIG. 13 illustrates a bottom perspective view of the feed lips 704. As shown, the feed lips 704 can include feed lip teeth 1300 on an interior surface 1302. In these or other examples, the feed lip teeth 1300 can engage a top portion of the adjustable shoulder 710 (e.g., top shoulder teeth 1402 described below in relation to FIGS. 14A, 14B, and 14E). In some examples, the feed lip teeth 1300 can provide increased engagement with the adjustable shoulder 710 when utilized in combination with the housing teeth 1200 on the housing 702. The increased engagement with the adjustable shoulder 710 can, in turn, provide greater impact load resistance during recoil and can improve overall reliability and structural integrity of the magazine 700. Additionally, in some examples, the feed lip teeth 1300 can restrain the adjustable shoulder 710 in a plane that is perpendicular to the interior surface 1202 (where the housing teeth 1200 are located). Multi-plane engagement with the adjustable shoulder 710 can also lend to improved impact load resistance during recoil and can improve overall reliability and structural integrity of the magazine 700.

Any of the features, components, and/or parts, including the arrangements and configurations thereof shown in FIG. 13 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIG. 13.

FIGS. 14A-14E illustrate various view of the adjustable shoulder 710 in accordance with one or more examples of the present disclosure. In particular, FIGS. 14A-14E respectively illustrate a rear perspective view, a front perspective view, a bottom perspective view, a side perspective close-up view, and a top perspective close-up view of the adjustable shoulder 710 according to one or more examples.

As shown, the adjustable shoulder 710 can include side shoulder teeth 1400 on one or both sides 1401 (i.e., mating surfaces) of the adjustable shoulder 710. The side shoulder teeth 1400 are one example of a position index or engagement interface, as discussed above. In particular examples, the side shoulder teeth 1400 can engage the housing teeth 1200 of the housing 702. For instance, the adjustable shoulder 710 can be inserted through the bottom of the housing 702 such that the housing teeth 1200 of the housing 702 are aligned to receive the side shoulder teeth 1400 of the adjustable shoulder 710. In specific implementations, the adjustable shoulder 710 can be inserted into the housing 702 until the bottom ends of the housing teeth 1200 contact a shelf 1409 of the adjustable shoulder 710, where the shelf 1409 supports the side shoulder teeth 1400. More detail of the side shoulder teeth 1400 is discussed below in relation to FIG. 14D.

Further shown, the adjustable shoulder 710 can include top shoulder teeth 1402. The top shoulder teeth 1402 are one example of a position index or engagement interface, as discussed above. In some examples, the adjustable shoulder 710 can include a pair of top shoulder teeth 1402 (e.g., dual rows of the top shoulder teeth 1402). In these or other examples, the top shoulder teeth 1402 can engage feed lip teeth 1300 of the feed lips 704. For instance, the adjustable shoulder 710 can be inserted into the housing 702 (e.g., from the bottom opening of the housing 702) until the top shoulder teeth 1402 engage the feed lip teeth 1300. Additional detail of the top shoulder teeth 1402 is discussed below in relation to FIG. 14E.

The adjustable shoulder 710 can further include a cover guide opening 1404. The cover guide opening 1404 allows a cover guide 908 (e.g., a protrusion, tab, or male alignment piece shown in FIG. 9) disposed on a top surface of the cover 706 to reside within the cover guide opening 1404. In certain examples, the cover guide opening 1404 allows the cover guide 908 to aid alignment and fitting of the cover 706 to the housing 702 by aligning the cover guide 908 to the cover guide opening 1404 of the adjustable shoulder 710.

Additionally, the adjustable shoulder 710 can include a contact surface 1406. The contact surface 1406 can be the same as or similar to the contact surface 606 discussed above. In particular, the adjustable shoulder 710 can include the contact surface 1406 on both sides of the channel 1104, thereby enabling contact with a cartridge shoulder. In these or other examples, the contact surface 1406 is perpendicular to the sides 1401 (or mating surfaces) having the side shoulder teeth 1400 and the top surfaces having the top shoulder teeth 1402.

Further, the adjustable shoulder 710 can include a bottom surface 1408. The bottom surface 1408 can include the indicator 804 of the various positions associated with the adjustable shoulder 710. As discussed above, the indicator 804 (including a discrete portion of the indicator 804) is viewable through the indicator window 802 of the cover 706. The bottom surface 1408, in some examples, can contact or be positioned adjacent to the top surface of the cover 706.

Figure 14D:
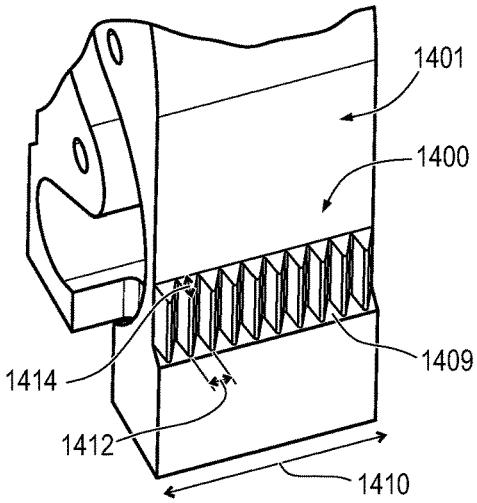

With respect to FIG. 14D, the side shoulder teeth 1400 can span a length 1410 that corresponds to a length of the side 1401. Alternatively, the length 1410 can be less than the length of the side 1401. Further, the side shoulder teeth 1400 can include a tooth spacing 1412 defined as an inter-tooth spacing measured between peaks or individual teeth. The tooth spacing 1412 can provide a desired resolution of adjustment. For example, a larger tooth spacing can provide fewer positional settings for an adjustable shoulder in comparison to a smaller tooth spacing. In addition, the side shoulder teeth 1400 can include a tooth height 1414 measured perpendicular from the side 1401 of the adjustable shoulder 710. The tooth height 1414 can disallow (or help reduce a likelihood of) the adjustable shoulder 710 being forcibly moved during recoil impact with a cartridge. Thus, increased tooth height can increase a surface area and thus increase an amount of impact load the adjustable shoulder 710 can take without movement relative to the housing teeth 1200.

Figure 14E:
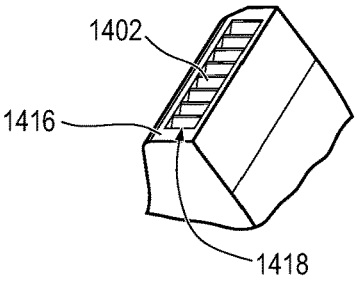

The top shoulder teeth 1402 can also include a variety of different configurations. In particular examples, and as shown in FIG. 14E, the top shoulder teeth 1402 can be positioned below a feed lip interface 1416 (i.e., another mating surface that mates with or joins to the interior surface 1302). For example, the feed lip interface 1416 can define an aperture 1418 within which the top shoulder teeth 1402 can be disposed. In these or other examples, the top shoulder teeth 1402 do not extend above the surface plane of the feed lip interface 1416 so that the feed lip interface 1416 can sit flush against the underside of the feed lips 704.

Any of the features, components, and/or parts, including the arrangements and configurations thereof shown in FIGS. 14A-14E can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 14A-14E.

As mentioned above, a magazine of the present disclosure can include various different types of magazines that implement an adjustable shoulder. One such magazine is a single rotor magazine—now discussed below in relation to FIGS. 15-24.

Figure 15:
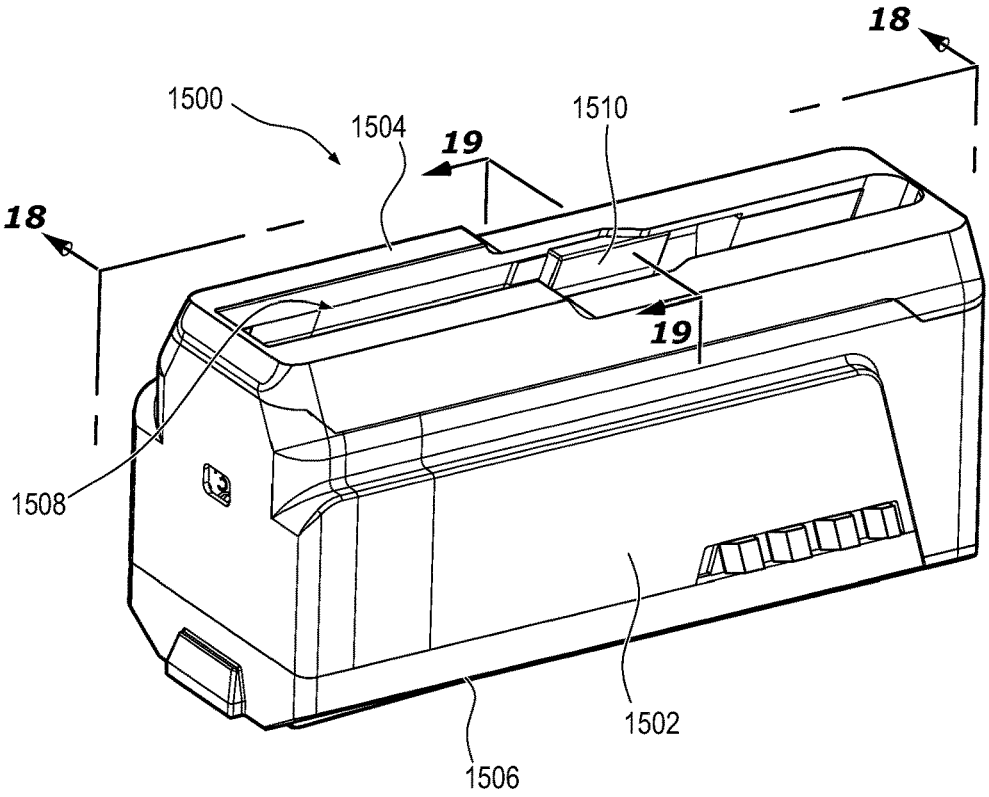
FIGS. 15-17 respectively illustrate top perspective, bottom perspective, and exploded views of yet another example magazine.
Figure 16:
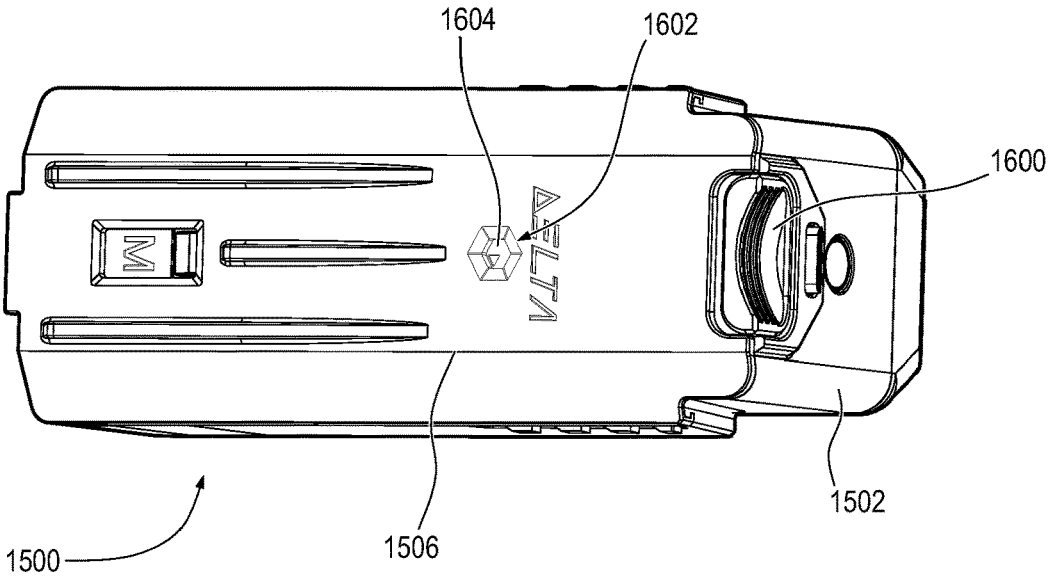
Figure 17:
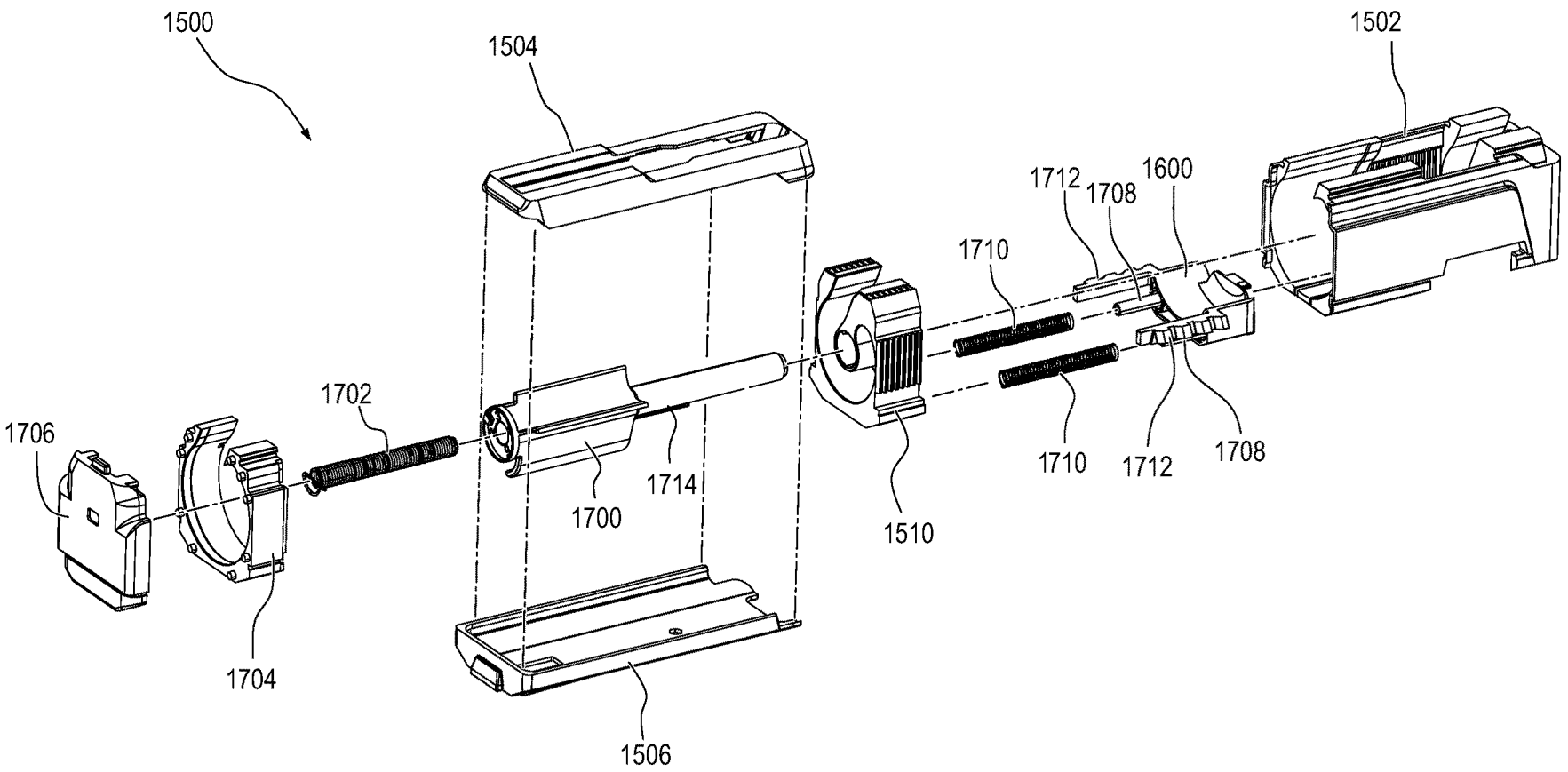

FIGS. 15-17 respectively illustrate top perspective, bottom perspective, and exploded views of a magazine 1500 in accordance with one or more examples of the present disclosure. The magazine 1500 can be the same as or similar to the magazine 105*a* discussed above in relation to FIG. 1A. Additionally or alternatively, the magazine 1500 can include one or more of the same or similar features discussed above in relation to the magazine 100 and the magazine 700. As shown, the magazine 1500 can include a housing 1502, feed lips 1504, a cover 1506, a cavity 1508, and an adjustable shoulder 1510. The housing 1502 can be the same as or similar to the housing 114 and/or the housing 702 discussed above. The feed lips 1504 can be the same as or similar to the feed lips 116 and/or the feed lips 704 discussed above. The cover 1506 can be the same as or similar to the cover 118 and/or the cover 706 discussed above. The cavity 1508 can be the same as or similar to the cavity 306 and/or the cavity 708 discussed above. The adjustable shoulder 1510 can also be functionally similar to the adjustable shoulder 112 and the adjustable shoulder 710 discussed above, but with structural differences for accommodating single-rotor action in the magazine. Additional detail for the adjustable shoulder 1510 is thus provided below in relation to FIGS. 19 and 22-24.

FIG. 16 further shows the cover 1506 can include a cover release 1600 and an indicator window 1602. The cover release 1600 can be actuated (e.g., via a button press or mash) to disengage the cover 1506 from the housing 1502. Alternatively, the cover release 1600 can include depressible tabs, fasteners, etc.

In some examples, the indicator window 1602 can include an opening, aperture, or a transparent area that allows visibility through the cover 1506. In these or other examples, the housing 1502 can align with an indicator 1604 positioned on a bottom side of the adjustable shoulder 1510. The feed lips 1504 can include a variety of different colors, markings, indicia, codes, symbols, arrows, shapes, etc. that represent a particular positioning of the adjustable shoulder 1510 within the magazine 1500.

Figure 23:
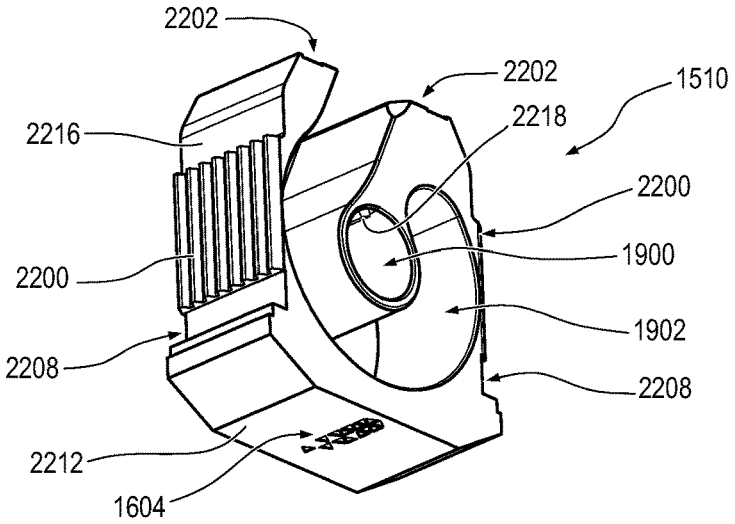

Additionally, it will be appreciated that the indicator 1604 can serve as a visual confirmation to a user that the adjustable shoulder 1510 is properly positioned for the desired cartridge. For example, a certain number of triangles as the indicator 1604 (when viewed through the housing 1502) can indicate a positioning of the adjustable shoulder 1510 corresponds to a set range of calibers, cartridge shoulder measurements, etc. Likewise, a different number of triangles as the indicator 1604 (when viewed through the housing 1502) can indicate a different positioning of the adjustable shoulder 1510 corresponds to a different range of calibers, different cartridge shoulder measurements, etc. A more complete view of the indicator 1604 associated with different adjustable shoulder positions within the magazine 1500 is shown in FIG. 23.

FIG. 17 further illustrates a rotor 1700 that can move cartridges through the magazine 1500. In these or other examples, the rotor 1700 can be torsionally biased (e.g., via a torsion spring 1702) to provide a desired rotation. Additionally, an end portion of the rotor 1700 can be mounted within a head 1706 of the housing 1502. In some examples, the head 1706 can include stop surfaces to engage (i.e., limit or bound rotation of) the end portions of the rotor 1700. Additionally or alternatively, the head 1706 can include a spring mount to affix an end portion of the spring 1702 to the housing 1502.

Further, in some examples, the rotor 1700 can be rotationally bound by a bracket 1704, which can include one or more surfaces to engage (e.g., abut or contact) associated rotor blades of the rotor 1700. Additionally or alternatively, in some examples, the bracket 1704 can be a mounting bracket or assembly bracket for assembling the head 1706 to the housing 1502 post-assembly of the rotor 1700 within the magazine 1500.

Any of the features, components, and/or parts, including the arrangements and configurations thereof shown in FIGS. 15-17 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 15-17.

Figure 18:
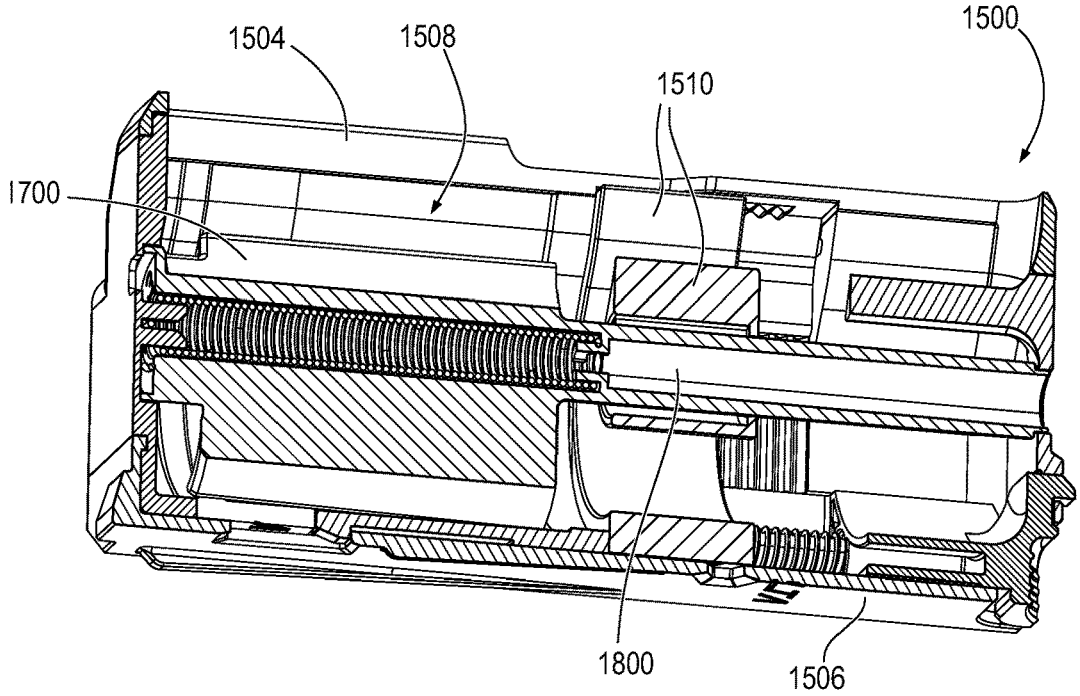
FIGS. 18-19 respectively illustrate lengthwise and widthwise cross-sections of an example magazine.
Figure 19:
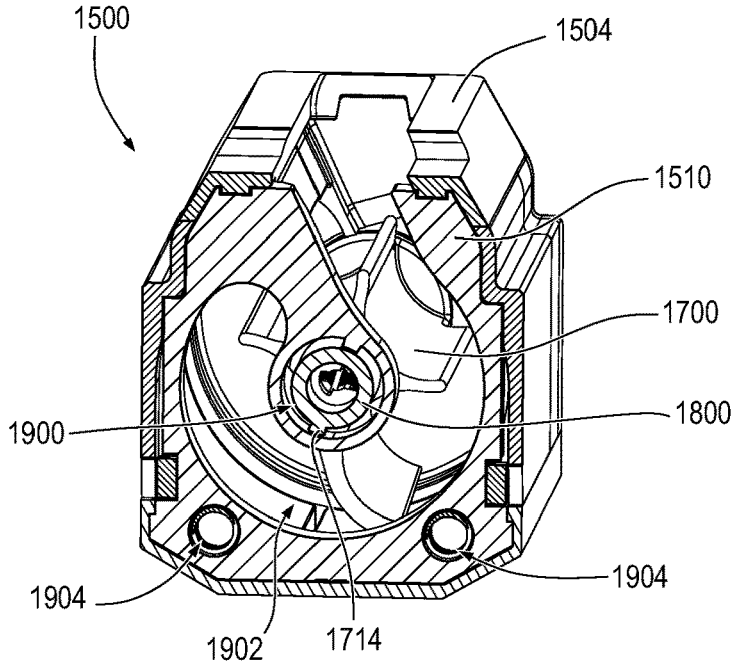

FIGS. 18-19 respectively illustrate lengthwise and widthwise cross-sections of the magazine 1500 in accordance with one or more examples of the present disclosure. FIG. 19 in particular is a cross-section taken widthwise through the adjustable shoulder 1510. As seen in these figures, the rotor 1700 with corresponding blades that can rotatably sweep cartridges in a curved path (e.g., a "J"-shaped path). As seen in FIG. 19, for example, the rotor 1700 can move cartridges through a channel 1902 defined by the adjustable shoulder 1510. The channel 1902 can include a through-slot in which a cartridge neck and bullet can travel (but not the cartridge shoulder).

The adjustable shoulder 1510 can further include a shaft opening 1900 corresponding to a shaft 1800 of the rotor 1700. In at least some examples, the shaft 1800 can rotate relative to the adjustable shoulder 1510, together with the blades of the rotor 1700.

In addition, the adjustable shoulder 1510 can include one or more cover release actuator openings 1904. The cover release actuator openings 1904 can be sized and shaped to receive pin rods 1708 (shown in FIG. 17) or other actuator elements of the cover release 1600. In certain examples, the cover release actuator openings 1904 can include one or more springs 1710 (also shown in FIG. 17) to bias the pin rods 1708 of the cover release 1600 away from the adjustable shoulder 1510.

Any of the features, components, and/or parts, including the arrangements and configurations thereof shown in FIGS. 18-19 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 18-19.

Figure 20:
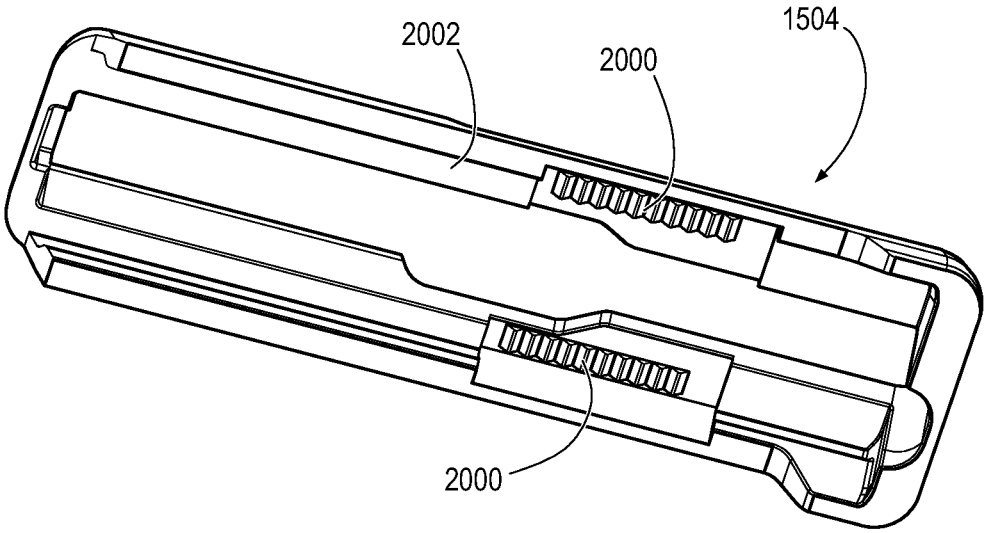
FIG. 20 illustrates a bottom perspective view of example feed lips.

In some implementations, the feed lips 1504 can include an engagement interface or position index (in addition to or alternatively to the housing 1502). In accordance with one or more such examples, FIG. 20 illustrates a bottom perspective view of the feed lips 1504. As shown, the feed lips 1504 can include feed lip teeth 2000 on an interior surface 2002. In these or other examples, the feed lip teeth 2000 can engage a top portion of the adjustable shoulder 1510 (e.g., top shoulder teeth 2202 described below in relation to FIGS. 22-24). In some examples, the feed lip teeth 2000 can provide increased engagement with the adjustable shoulder 1510 when utilized in combination with housing teeth (e.g., housing teeth 2100 on the housing 1502 as describe below in relation to FIG. 21). The increased engagement with the adjustable shoulder 1510 can, in turn, provide greater impact load resistance during recoil and can improve overall reliability and structural integrity of the magazine 1500. Additionally, in some examples, the feed lip teeth 2000 can restrain the adjustable shoulder 1510 in a plane that is perpendicular to an interior surface of the housing 1502. Multi-plane engagement with the adjustable shoulder 1510 can also lend to improved impact load resistance during recoil and can improve overall reliability and structural integrity of the magazine 1500.

Any of the features, components, and/or parts, including the arrangements and configurations thereof shown in FIG. 20 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIG. 20.

Figure 21:
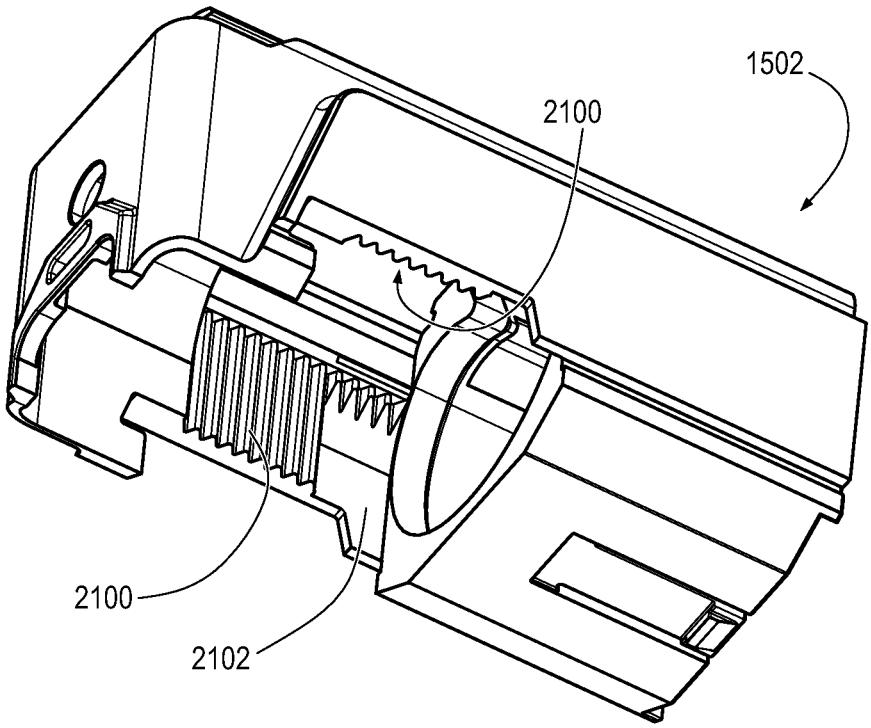
FIG. 21 illustrates a bottom perspective view of an example magazine housing.

As mentioned above, the housing of a magazine can engage an adjustable shoulder. The housing can include many different configurations of an engagement interface or position index to engage the adjustable shoulder. In particular implementations, an interior surface of the housing can engage an adjustable shoulder. FIG. 21 illustrates a bottom perspective view of the housing 1502 having housing teeth 2100 in accordance with one or more examples of the present disclosure.

As shown in FIG. 21, the housing teeth 2100 are positioned on an interior surface 2102 (rather than an upper or lower periphery as in the magazine 100). Albeit limited by the illustrated view, the housing teeth 2100 can be positioned on both opposing sides of the interior surface 2102 (e.g., so as to engage opposite sides of the adjustable shoulder 1510, such as side shoulder teeth 2200 discussed below in relation to FIGS. 22-24). Further, in some examples, the housing teeth 2100 can be positioned (and dimensioned) to provide a wide variety of different positions for the adjustable shoulder 1510. In this way, the adjustable shoulder 1510 can be adjusted relative to the housing 1502 to accommodate a host of different calibers (and associated cartridge shoulder positions) within the magazine 1500. Other types of engagement interfaces or position indices besides the housing teeth are herein contemplated, as discussed above.

Any of the features, components, and/or parts, including the arrangements and configurations thereof shown in FIG. 21 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIG. 21.

Figure 22:
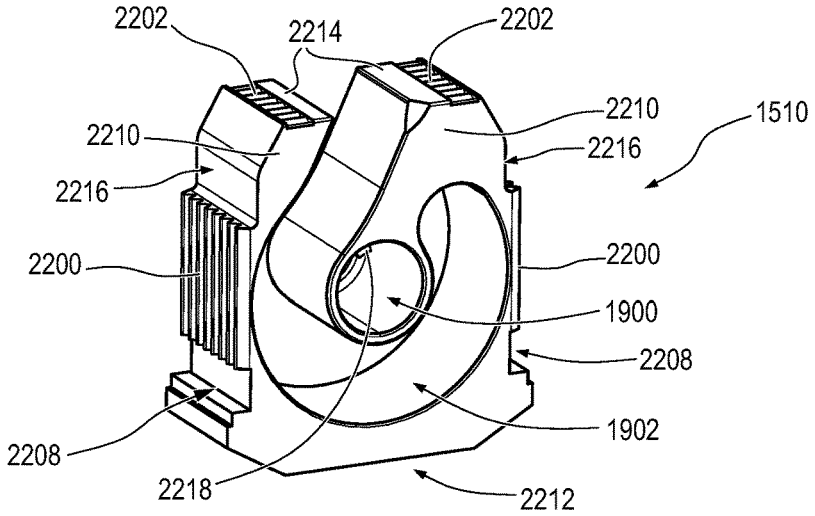
FIGS. 22-24 respectively illustrate a rear perspective view, bottom-front perspective view, and a front perspective view of an example adjustable shoulder.
Figure 24:
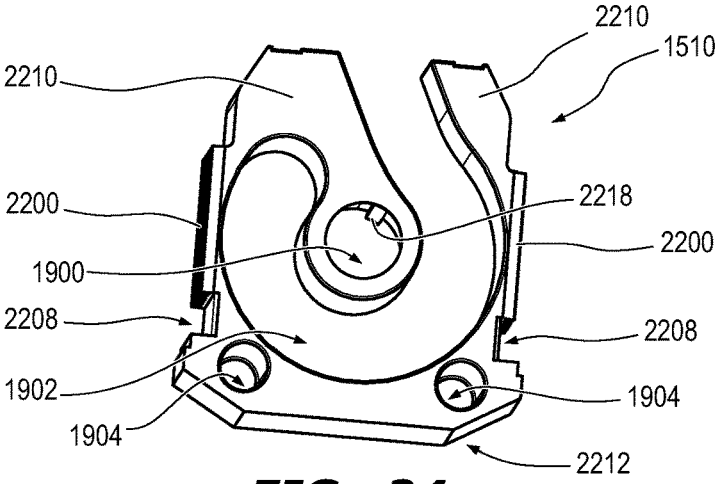

FIGS. 22-24 illustrate various view of the adjustable shoulder 1510 in accordance with one or more examples of the present disclosure. In particular, FIGS. 22-24 respectively illustrate a rear perspective view, bottom-front perspective view, and a front perspective view of the adjustable shoulder 1510 according to one or more examples.

As shown, the adjustable shoulder 1510 can include side shoulder teeth 2200 on one or both sides 2216 (or mating surfaces) of the adjustable shoulder 1510. The side shoulder teeth 2200 are one example of a position index or engagement interface, as discussed above. In particular examples, the side shoulder teeth 2200 can engage the housing teeth 2100 of the housing 1502. For instance, the adjustable shoulder 1510 can be inserted through the bottom of the housing 1502 such that the housing teeth 2100 of the housing 1502 are aligned to receive the side shoulder teeth 2200 of the adjustable shoulder 1510.

Further shown, the adjustable shoulder 1510 can include top shoulder teeth 2202. The top shoulder teeth 2202 are one example of a position index or engagement interface, as discussed above. In some examples, the adjustable shoulder 1510 can include a pair of top shoulder teeth 2202 (e.g., dual rows of the top shoulder teeth 2202 on top surfaces 2214). In certain examples, the top shoulder teeth 2202 can be recessed (i.e., disposed below the top surface 2214) so that the top surface 2214 (i.e., an additional mating surface) can sit flush against the interior surface 2002 of the feed lips 1504. In these or other examples, the top shoulder teeth 2202 can engage feed lip teeth 2000 of the feed lips 1504 (thereby mating with the feed lips 1504). For instance, the adjustable shoulder 1510 can be inserted into the housing 1502 (e.g., from the bottom opening of the housing 1502) until the top shoulder teeth 2202 engage the feed lip teeth 2000.

In one or more examples, the adjustable shoulder 1510 can include a pair of release slide slots 2208 disposed below the side shoulder teeth 2200. The release slide slots 2208 can be sized and shaped to slidably receive a pair of release slides 1712 (shown in FIG. 17) of the cover release 1600. Thus, in particular implementations, the pair of release slides 1712 can be disposed within the release slide slots 2208 when the magazine 1500 is assembled. In certain examples, upon actuation of the cover release 1600, the pair of release slides 1712 can correspondingly advance further through the release slide slots 2208.

Additionally, the adjustable shoulder 1510 can include a contact surface 2210. The contact surface 2210 can be the same as or similar to the contact surfaces 606, 1406 discussed above. In particular, the adjustable shoulder 1510 can include the contact surface 2210 on both sides of the channel 1902, thereby enabling contact with a cartridge shoulder. In these or other examples, the contact surface 2210 is perpendicular to the sides 2216 having the side shoulder teeth 2200 and the top surfaces 2214 having the top shoulder teeth 2202.

Further, the adjustable shoulder 1510 can include a bottom surface 2212. The bottom surface 2212 can include the indicator 1604 of the various positions associated with the adjustable shoulder 1510. As discussed above, the indicator 1604 (including a discrete portion of the indicator 1604) can be viewable through the indicator window 1602 of the cover 1506. The bottom surface 2212, in some examples, can contact or be positioned adjacent to the top surface of the cover 1506.

In some examples, the adjustable shoulder 1510 can include a shaft stop 2218 disposed on an interior surface defining the shaft opening 1900. In particular examples, the shaft stop 2218 can limit a rotation of the shaft 1800 of the rotor 1700. For instance, the shaft 1800 can include a rib 1714 (shown in FIGS. 17 and 19) that can contact the shaft stop 2218 of the adjustable shoulder 1510 at a predetermined rotational limit.

Any of the features, components, and/or parts, including the arrangements and configurations thereof shown in FIGS. 22-24 can be included, either alone or in any combination, in any of the other examples of devices, features, components, and parts shown in the other figures described herein. Likewise, any of the features, components, and/or parts, including the arrangements and configurations thereof shown and described with reference to the other figures can be included, either alone or in any combination, in the example of the devices, features, components, and parts shown in FIGS. 22-24.

The foregoing description, for purposes of explanation, used specific nomenclature to provide a thorough understanding of the described aspects. However, it will be apparent to one skilled in the art that the specific details are not required in order to practice the described aspects. Thus, the foregoing descriptions of the specific aspects described herein are presented for purposes of illustration and description. They are not intended to be exhaustive or to limit the aspects to the precise forms disclosed.

It will be apparent to one of ordinary skill in the art that many modifications and variations are possible in view of the above teachings. Indeed, various inventions have been described herein with reference to certain specific aspects and examples. However, they will be recognized by those skilled in the art that many variations are possible without departing from the scope and spirit of the inventions disclosed herein. Specifically, those inventions set forth in the claims below are intended to cover all variations and modifications of the inventions disclosed without departing from the spirit of the inventions. The terms "including" or "includes" as used in the specification shall have the same meaning as the term "comprising."

What is claimed is:

1. A firearm magazine, comprising:

a housing comprising an upper periphery, a lower periphery, and an interior surface extending between the upper periphery and the lower periphery, wherein the interior surface defines a cavity sized to receive multiple sizes of cartridges;

housing teeth positioned on at least one of the upper periphery, the lower periphery, or the interior surface; and an adjustable shoulder positioned within the housing to accommodate multiple sizes of cartridges, the adjustable shoulder comprising:

shoulder teeth engageable with the housing teeth; and a stop surface engageable with a cartridge shoulder.

2. The firearm magazine of claim 1, wherein a positioning of the adjustable shoulder relative to the housing teeth defines an axial shoulder spacing between the cartridge shoulder and the stop surface.

3. The firearm magazine of claim 1, wherein the adjustable shoulder is translatable in a direction parallel to a cartridge.

4. The firearm magazine of claim 1, wherein the adjustable shoulder is removable from the firearm magazine.

5. The firearm magazine of claim 1, wherein the adjustable shoulder comprises a pair of adjustable shoulders respectively engaged with the housing teeth, the housing teeth being positioned on opposing sides of the housing.

6. The firearm magazine of claim 5, wherein a cartridge neck is configured to be positioned between the pair of adjustable shoulders.

7. The firearm magazine of claim 1, further comprising feed lips positionable adjacent to the upper periphery of the housing, wherein the adjustable shoulder comprises a feed lip interface positioned adjacent to the feed lips.

8. The firearm magazine of claim 7, wherein the feed lips are positioned on top of the feed lip interface to maintain a positioning of the adjustable shoulder relative to the housing teeth.

9. The firearm magazine of claim 7, wherein:

the adjustable shoulder comprises additional shoulder teeth disposed on a top portion of the adjustable shoulder; and the feed lips comprise feed lip teeth engageable with the additional shoulder teeth.

10. The firearm magazine of claim 1, wherein the firearm magazine is a rotary magazine.

11. A firearm magazine, comprising:

a housing;

feed lips positioned on top of the housing;

a position index located on at least one of the housing or the feed lips; and a movable stop engageable with the position index to position the movable stop at a plurality of positions within the housing to accommodate multiple sizes of cartridges, wherein when the movable stop is set at a position of the plurality of positions, the movable stop is configured to restrain forward axial movement of a cartridge via contact with a cartridge shoulder.

12. The firearm magazine of claim 11, wherein:

the housing includes an upper periphery and a lower periphery; and the position index is located at both the upper periphery and the lower periphery.

13. The firearm magazine of claim 11, wherein the position index includes teeth configured to positionally lock the movable stop when set at the position of the plurality of positions.

14. The firearm magazine of claim 11, wherein the movable stop includes a first set of teeth disposed on a top portion of the movable stop and a second set of teeth disposed on a side portion of the movable stop.

15. An adjustable insert for a firearm magazine, the adjustable insert comprising:

a contact surface to contact a cartridge shoulder; and an engagement interface positioned on a mating surface, the engagement interface being engageable with a portion of the firearm magazine, wherein the engagement interface comprises a predetermined adjustment resolution for incrementally adjusting the adjustable insert forward and backward along a plane parallel to a longitudinal axis of the firearm magazine to accommodate multiple sizes of cartridges.

16. The adjustable insert of claim 15, further comprising a channel through which portions of a cartridge can move when a rotor of the firearm magazine guides the cartridge.

17. The adjustable insert of claim 16, wherein the channel includes an S-shaped channel.

18. The adjustable insert of claim 15, further comprising at least one shaft opening sized and shaped to receive a rotor shaft.

19. The adjustable insert of claim 15, wherein the mating surface is positioned perpendicular to the contact surface.

20. The adjustable insert of claim 15, wherein:

the engagement interface is a first engagement interface positioned on a side portion of the adjustable insert; and the engagement interface further comprises a second engagement interface positioned on a top portion of the adjustable insert.

* * * * *